US007467984B2

(12) United States Patent
Van de Rostyne

(10) Patent No.: US 7,467,984 B2
(45) Date of Patent: Dec. 23, 2008

(54) HELICOPTER

(75) Inventor: Alexander Jozef Magdalena Van de Rostyne, Bornem (BE)

(73) Assignee: Silverlit Toys Manufactory Ltd. (HK)

( * ) Notice: Subject to any disclaimer, the term of this patent is extended or adjusted under 35 U.S.C. 154(b) by 0 days.

(21) Appl. No.: 11/842,719

(22) Filed: Aug. 21, 2007

(65) Prior Publication Data

US 2007/0272794 A1 Nov. 29, 2007

Related U.S. Application Data

(60) Continuation of application No. 11/754,752, filed on Jun. 14, 2007, which is a division of application No. 11/465,781, filed on Aug. 18, 2006, which is a continuation-in-part of application No. 11/462,177, filed on Aug. 3, 2006.

(30) Foreign Application Priority Data

Jan. 19, 2006 (BE) ..... 2006/0043

(51) Int. Cl.
*A63H 27/127* (2006.01)
*B64C 11/00* (2006.01)
*B64C 27/54* (2006.01)

(52) U.S. Cl. ..... 446/36; 244/17.13

(58) Field of Classification Search ..... 446/34, 446/36, 37, 38, 230, 232, 236, 238; 244/7 A, 244/7 B, 17.11, 17.13, 17.19, 17.21, 17.23, 244/17.25, 35 R, 153 A; 416/223 R, 243, 416/DIG. 2

See application file for complete search history.

(56) References Cited

U.S. PATENT DOCUMENTS 1,403,909 A 1/1922 Moir
1,446,522 A 2/1923 Smith
1,773,281 A 8/1930 Scott
1,800,470 A * 4/1931 Etienne Oehmichen ..... 416/40
1,925,156 A * 9/1933 Vaughn ..... 416/128
2,030,578 A 2/1936 Flettner
2,110,563 A 3/1938 Thaon
2,307,381 A 1/1943 Bess
2,368,698 A 2/1945 Young (Continued)

FOREIGN PATENT DOCUMENTS

BE 338599 12/1926

(Continued)

OTHER PUBLICATIONS

U.S. Appl. No. 11/953,823, filed Dec. 10, 2007, Van de Rostyne.

(Continued)

*Primary Examiner*—Eugene Kim
*Assistant Examiner*—Alyssa M Hylinski
(74) *Attorney, Agent, or Firm*—Greenberg Traurig, LLP

(57) ABSTRACT

A helicopter has a main rotor with propeller blades which is driven by a rotor shaft and which is hinge-mounted to this rotor shaft. The angle between the surface of rotation of the main rotor and the rotor shaft may vary. A swinging manner on an oscillatory shaft is essentially transverse to the rotor shaft of the main rotor and is directed transversally to the longitudinal axis of the vanes. The main rotor and the auxiliary rotor are connected to each other by a mechanical link. The swinging motions of the auxiliary rotor controls the angle of incidence (A) of at least one of the propeller blades of the main rotor. There are wings from the body and a stabilizer at the tail.

20 Claims, 18 Drawing Sheets

U.S. PATENT DOCUMENTS

| | | | | | |
|---|---|---|---|---|---|
| 2,384,516 | A | * | 9/1945 | Young | 416/18 |
| 2,411,596 | A | | 11/1946 | Shapiro | |
| 2,413,831 | A | | 1/1947 | Jordan | |
| 2,429,502 | A | | 10/1947 | Young | |
| D149,130 | S | | 3/1948 | Katenberter et al. | |
| 2,439,143 | A | | 4/1948 | Nemeth | |
| D153,314 | S | | 4/1949 | Piasecki | |
| D153,315 | S | | 4/1949 | Piasecki | |
| D153,316 | S | | 4/1949 | Piasecki | |
| D153,317 | S | | 4/1949 | Piasecki | |
| 2,469,144 | A | | 5/1949 | Baggott | |
| 2,481,750 | A | | 9/1949 | Hiller, Jr. et al. | |
| 2,486,059 | A | | 10/1949 | Pentecost | |
| 2,487,020 | A | * | 11/1949 | Gilerease | 416/127 |
| 2,514,822 | A | | 7/1950 | Wolfe, Jr. | |
| 2,532,683 | A | | 12/1950 | Traver | |
| 2,554,938 | A | | 5/1951 | Catalano | |
| D163,938 | S | * | 7/1951 | Douglas | D12/329 |
| 2,563,731 | A | | 8/1951 | Masterson | |
| 2,629,568 | A | | 2/1953 | Croshere, Jr. et al. | |
| 2,633,924 | A | | 4/1953 | Young | |
| 2,639,874 | A | * | 5/1953 | Stalker | 244/209 |
| 2,646,848 | A | * | 7/1953 | Young | 416/18 |
| 2,629,570 | A | | 12/1953 | Carnahan | |
| D171,569 | S | | 3/1954 | Apostolescu | |
| 2,725,494 | A | | 11/1955 | Anderson | |
| D178,081 | S | | 6/1956 | Papadakos | |
| 2,750,131 | A | | 6/1956 | Thomson | |
| D181,643 | S | | 12/1957 | Graham | |
| D184,501 | S | | 2/1959 | Wlashin et al. | |
| 2,923,494 | A | | 2/1960 | Strong | |
| D187,625 | S | | 4/1960 | Apostolescu | |
| D187,895 | S | | 5/1960 | Douglas | |
| 2,950,074 | A | | 8/1960 | Apostolescu | |
| 2,980,187 | A | * | 4/1961 | Smyth-Davila | 416/18 |
| 3,029,048 | A | | 4/1962 | Brooks et al. | |
| 3,035,643 | A | | 5/1962 | Kelley et al. | |
| 3,068,611 | A | * | 12/1962 | Lauderdale | 446/30 |
| 3,080,001 | A | * | 3/1963 | Culver et al. | 416/18 |
| 3,093,929 | A | | 6/1963 | Robbins et al. | |
| 3,106,964 | A | | 10/1963 | Culver et al. | |
| 3,116,896 | A | | 1/1964 | Sigler et al. | |
| 3,135,334 | A | * | 6/1964 | Culver | 416/18 |
| 3,180,424 | A | | 4/1965 | Serriades | |
| 3,213,944 | A | | 10/1965 | Nichols et al. | |
| 3,228,478 | A | | 1/1966 | Edenborough | |
| 3,231,222 | A | * | 1/1966 | Scheutzow | 244/17.19 |
| D205,326 | S | | 7/1966 | Postelson-Apostolescu | |
| 3,370,809 | A | | 2/1968 | Leoni | |
| 3,371,886 | A | | 3/1968 | Schertz | |
| 3,391,746 | A | * | 7/1968 | Cardoso | 416/128 |
| 3,409,249 | A | | 11/1968 | Bergquist et al. | |
| 3,448,810 | A | | 6/1969 | Vogt | |
| 3,450,374 | A | | 6/1969 | Moore | |
| 3,481,559 | A | | 12/1969 | Apostolescu | |
| 3,572,616 | A | | 3/1971 | Ulisnik | |
| 3,592,559 | A | | 7/1971 | Ward | |
| D221,453 | S | * | 8/1971 | Swanberg | D21/444 |
| 3,625,631 | A | | 12/1971 | Covington, Jr. et al. | |
| 3,662,487 | A | * | 5/1972 | Seefluth | 446/37 |
| 3,759,629 | A | | 9/1973 | Abramopaulos | |
| 3,771,924 | A | | 11/1973 | Buchstaller | |
| D232,168 | S | | 7/1974 | Leoni | |
| D232,170 | S | | 7/1974 | Diamond et al. | |
| D234,350 | S | | 2/1975 | Beckert et al. | |
| 3,933,324 | A | | 1/1976 | Ostrowski | |
| D239,930 | S | | 5/1976 | Ulisnik | |
| 4,025,230 | A | | 5/1977 | Kastan | |
| 4,053,123 | A | | 10/1977 | Chadwick | |
| 4,073,086 | A | | 2/1978 | Ogawa | |
| 4,084,345 | A | * | 4/1978 | Tanaka | 446/44 |
| 4,118,143 | A | * | 10/1978 | Kavan | 416/18 |
| 4,142,697 | A | | 3/1979 | Fradenburgh | |
| D253,003 | S | | 9/1979 | Tanaka | |
| 4,173,321 | A | | 11/1979 | Eickmann | |
| 4,227,856 | A | | 10/1980 | Verrill et al. | |
| 4,307,533 | A | | 12/1981 | Sims et al. | |
| 4,519,746 | A | | 5/1985 | Wainauski et al. | |
| 4,522,563 | A | | 6/1985 | Reyes et al. | |
| 4,629,440 | A | | 12/1986 | McKittrick et al. | |
| D294,605 | S | | 3/1988 | Matsumoto | |
| 4,880,355 | A | * | 11/1989 | Vuillet et al. | 416/228 |
| 4,981,456 | A | * | 1/1991 | Sato et al. | 446/36 |
| 5,015,187 | A | | 5/1991 | Lord | |
| 5,108,043 | A | | 4/1992 | Canavaspe | |
| 5,151,014 | A | | 9/1992 | Greenwald et al. | |
| 5,190,242 | A | * | 3/1993 | Nichols | 244/12.2 |
| 5,209,429 | A | | 5/1993 | Doolin et al. | |
| 5,240,204 | A | | 8/1993 | Kunz | |
| 5,252,100 | A | * | 10/1993 | Osawa et al. | 446/44 |
| 5,255,871 | A | * | 10/1993 | Ikeda | 244/17.13 |
| 5,259,729 | A | * | 11/1993 | Fujihira et al. | 416/25 |
| 5,304,090 | A | * | 4/1994 | Vanni | 446/36 |
| 5,370,341 | A | | 12/1994 | Leon | |
| D357,894 | S | | 5/1995 | Arnold et al. | |
| 5,505,407 | A | | 4/1996 | Chiapetta | |
| 5,511,947 | A | | 4/1996 | Schmuck | |
| D372,741 | S | | 8/1996 | Tsai | |
| D378,606 | S | | 3/1997 | Tamagnini | |
| 5,609,312 | A | * | 3/1997 | Arlton et al. | 244/17.11 |
| 5,628,620 | A | | 5/1997 | Arlton | |
| D388,048 | S | | 12/1997 | Taylor et al. | |
| D390,942 | S | | 2/1998 | Mei | |
| 5,749,540 | A | | 5/1998 | Arlton | |
| 5,836,545 | A | | 11/1998 | Arlton et al. | |
| 5,879,131 | A | | 3/1999 | Arlton et al. | |
| 5,906,476 | A | | 5/1999 | Arlton | |
| 5,915,649 | A | | 6/1999 | Head | |
| 6,000,911 | A | | 12/1999 | Toulmay et al. | |
| D421,279 | S | | 2/2000 | Tsai | |
| 6,032,899 | A | | 3/2000 | Mondet et al. | |
| 6,039,541 | A | | 3/2000 | Parker et al. | |
| D425,853 | S | | 5/2000 | Caporaletti | |
| 6,086,016 | A | * | 7/2000 | Meek | 244/17.11 |
| 6,302,652 | B1 | | 10/2001 | Roberts | |
| 6,398,618 | B1 | | 6/2002 | Wu | |
| 6,435,453 | B1 | | 8/2002 | Carter, Jr. | |
| 6,460,802 | B1 | | 10/2002 | Norris | |
| 6,467,726 | B1 | | 10/2002 | Hosoda | |
| D467,861 | S | | 12/2002 | Lee | |
| 6,499,690 | B1 | | 12/2002 | Katayama et al. | |
| 6,543,726 | B2 | | 4/2003 | Illingworth | |
| 6,632,119 | B2 | | 10/2003 | Chernek et al. | |
| 6,659,395 | B2 | | 12/2003 | Rehkemper et al. | |
| 6,659,721 | B1 | | 12/2003 | Parker et al. | |
| 6,702,552 | B1 | | 3/2004 | Harman | |
| 6,719,244 | B1 | | 4/2004 | Gress | |
| 6,732,973 | B1 | | 5/2004 | Rehkemper | |
| 6,745,977 | B1 | | 6/2004 | Long et al. | |
| 6,749,401 | B2 | | 6/2004 | Vanmoor | |
| 6,758,436 | B2 | | 7/2004 | Rehkemper et al. | |
| 6,789,764 | B2 | | 9/2004 | Bass et al. | |
| 6,884,034 | B1 | | 4/2005 | Parker et al. | |
| 6,886,777 | B2 | | 5/2005 | Rock | |
| 6,899,586 | B2 | * | 5/2005 | Davis | 446/37 |
| 6,929,215 | B2 | | 8/2005 | Arlton | |
| 6,960,112 | B2 | * | 11/2005 | Helmlinger et al. | 446/36 |
| 6,978,969 | B1 | | 12/2005 | Neal | |
| D524,227 | S | | 7/2006 | Stille et al. | |
| D524,228 | S | | 7/2006 | Scott et al. | |
| D524,229 | S | | 7/2006 | Stille et al. | |
| D524,230 | S | | 7/2006 | Stille et al. | |
| D524,718 | S | | 7/2006 | Scott et al. | |
| 7,100,866 | B2 | | 9/2006 | Rehkemper et al. | |

| | | | | |
|---|---|---|---|---|
| 7,178,758 | B2 | 2/2007 | Rehkemper | |
| 7,188,803 | B2 | 3/2007 | Ishiba | |
| 7,198,223 | B2 | 4/2007 | Phelps, III et al. | |
| 7,204,453 | B2 | 4/2007 | Muren | |
| D544,825 | S | 6/2007 | Van de Rostyne et al. | |
| D545,755 | S | 7/2007 | Van de Rostyne et al. | |
| D546,269 | S | 7/2007 | Van de Rostyne et al. | |
| 7,246,769 | B2 | 7/2007 | Yoeli | |
| D548,803 | S | 8/2007 | Zimet | |
| 7,264,199 | B2 | 9/2007 | Zientek | |
| 7,273,195 | B1 | 9/2007 | Golliher | |
| D552,531 | S | 10/2007 | Van de Rostyne et al. | |
| D554,040 | S | 10/2007 | Van de Rostyne et al. | |
| 7,306,186 | B2 | 12/2007 | Kusic | |
| D559,764 | S | 1/2008 | Wai | |
| D561,084 | S | 2/2008 | Wai | |
| D561,679 | S | 2/2008 | Wai | |
| 2002/0008759 | A1 | 1/2002 | Hoyos | |
| 2002/0109044 | A1* | 8/2002 | Rock | 244/17.23 |
| 2002/0134883 | A1 | 9/2002 | Stamps et al. | |
| 2004/0087241 | A1 | 5/2004 | Agostini et al. | |
| 2004/0184915 | A1 | 9/2004 | Kunii et al. | |
| 2004/0222329 | A1 | 11/2004 | Kuhns et al. | |
| 2004/0245376 | A1 | 12/2004 | Muren | |
| 2005/0121552 | A1* | 6/2005 | Rehkemper | 244/17.11 |
| 2005/0121553 | A1* | 6/2005 | Isawa et al. | 244/17.19 |
| 2006/0102777 | A1 | 5/2006 | Rock | |
| 2006/0121819 | A1* | 6/2006 | Isawa | 446/37 |
| 2006/0231677 | A1* | 10/2006 | Zimet et al. | 244/17.23 |
| 2007/0012818 | A1* | 1/2007 | Miyazawa et al. | 244/17.25 |
| 2007/0017724 | A1 | 1/2007 | Rajasingham | |
| 2007/0105475 | A1 | 5/2007 | Gotou et al. | |
| 2007/0164148 | A1 | 7/2007 | Van de Rostyne | |
| 2007/0164149 | A1 | 7/2007 | Van de Rostyne | |
| 2007/0164150 | A1 | 7/2007 | Van de Rostyne | |
| 2007/0178798 | A1 | 8/2007 | Lai | |
| 2007/0181742 | A1 | 8/2007 | Van de Rostyne et al. | |
| 2007/0187549 | A1 | 8/2007 | Owen | |
| 2007/0215750 | A1 | 9/2007 | Shantz et al. | |
| 2007/0221781 | A1 | 9/2007 | Van de Rostyne | |
| 2007/0262197 | A1 | 11/2007 | Phelps et al. | |
| 2008/0076319 | A1 | 3/2008 | Van de Rostyne | |
| 2008/0076320 | A1 | 3/2008 | Van de Rostyne | |
| 2008/0085653 | A1 | 4/2008 | Van de Rostyne | |
| 2008/0111399 | A1 | 5/2008 | Zierten | |
| 2008/0112808 | A1 | 5/2008 | Schmaling et al. | |
| 2008/0207079 | A1 | 8/2008 | Corsiglia et al. | |

FOREIGN PATENT DOCUMENTS

| | | | |
|---|---|---|---|
| BE | 1016960 | | 11/2007 |
| DE | 1 270 408 | | 6/1968 |
| DE | 40 17 402 | A1 | 12/1991 |
| DE | 94 14 652 | U1 | 11/1994 |
| DE | 203 14 041 | U1 | 4/2004 |
| EP | 0 250 135 | | 12/1987 |
| EP | 0 727 350 | | 8/1996 |
| EP | 1462362 | A1 | 9/2004 |
| ES | P0233821 | | 8/1957 |
| ES | P0234258 | | 9/1957 |
| ES | P0245313 | | 4/1959 |
| ES | P0283794 | | 1/1963 |
| ES | 490715 | | 4/1980 |
| ES | 275141 | | 7/1982 |
| ES | 0298826 | | 1/1989 |
| ES | 0464158 | | 1/1992 |
| ES | 2 074 010 | | 8/1995 |
| ES | 0727350 | | 8/1996 |
| ES | 2 172 362 | | 9/2002 |
| ES | 1238185 | | 9/2002 |
| ES | 1462362 | | 9/2004 |
| GB | 255936 | | 7/1926 |
| GB | 272871 | | 5/1927 |
| GB | 281721 | | 8/1928 |
| GB | 916894 | A | 1/1963 |
| GB | 956536 | | 4/1964 |
| GB | 958536 | | 5/1964 |
| GB | 1081341 | A | 8/1967 |
| GB | 2 436 258 | A | 9/2007 |
| JP | S30-7668 | | 10/1930 |
| JP | S32-003535 | | 6/1932 |
| JP | 1269699 | | 10/1989 |
| JP | 5192452 | | 8/1993 |
| JP | 8150818 | | 6/1996 |
| JP | 9048398 | | 2/1997 |
| JP | 9512515 | | 12/1997 |
| JP | 10076996 | | 3/1998 |
| JP | 2000-272594 | | 10/2000 |
| JP | 2003-103066 | | 4/2003 |
| JP | 2003-220999 | | 8/2003 |
| JP | 2004-121798 | | 4/2004 |
| JP | 2005-193905 | | 7/2005 |
| JP | 2006-051217 | | 2/2006 |
| WO | WO03/080433 | A1 | 10/2003 |
| WO | WO2006/075096 | | 7/2006 |

OTHER PUBLICATIONS

U.S. Appl. No. 11/953,826, filed Dec. 10, 2007, Van de Rostyne.

U.S. Appl. No. 11/953,830, filed Dec. 10, 2007, Van de Rostyne.

U.S. Appl. No. 29/282,581, filed Jul. 24, 2007, Van de Rostyne, et al.

U.S. Appl. No. 29/283,934, filed Aug. 27, 2007, Van de Rostyne, et al.

U.S. Appl. No. 29/297,478, filed Nov. 12, 2007, Van de Rostyne, et al.

U.S. Appl. No. 29/297,479, filed Nov. 12, 2007, Van de Rostyne, et al.

U.S. Appl. No. 29/297,765, filed Nov. 16, 2007, Van de Rostyne, et al.

U.S. Appl. No. 29/302,018, filed Jan. 8, 2008, Van de Rostyne, et al.

U.S. Appl. No. 29/302,020, filed Jan. 8, 2008, Van de Rostyne, et al.

Selberg, B.P.; Cronin, D.L.; Rokhsaz, K.; Dykman, J.R., Yager, C. J. "Aerodynamic-Structural Analysis of Dual Bladed Helicopter Systems (Field Technical Report", Report No. NASA-CR-162754, Feb. 1980 46p (Abstract).

Ham, Normand. Helicopter individual-blade-control research at MIT 1977-1985; DGLR, European Rotorcraft Forum, 12th, Garmisch-Partenkirchen, West Germany; Germany, Federal Republic of; Sep. 22-25, 1986 10 pp. 1986 (Abstract).

Proctor, Paul. "Aviation Week & Space Technology", v146, n13, p47(1), Mar. 31, 1997 (Abstract).

Zein-Sabatto, S.; Zheng, Y. "Intelligent Flight Controllers for Helicopter Control"; 1997 IEEE International Conference on Neural Networks, Proceedings (Cat. No. 97CH36109) Part vol. 2 p. 617-21 vol. 2 (Abstract).

Mirick, Paul H. "A Comparison of Theory and Experiment for Coupled Rotor Body Stability of a Bearingless Rotor Model in Hover and Forward Flight", Jun. 1, 1988, IP Document Id 19880017770 pp. 87-101 (Abstract).

US District Court, Eastern District of Virginia, Norfolk Division, *Silverlit Toys Manufactory, Ltd*., et al. *v. Westminster, Inc*., et al., Case No. 2:07-cv-472-JBF/JEB.

US District Court, Northern District of Georgia, Atlanta Division, *Westminster, Inc. v. Silverlit Toys Manufactory, Ltd*., et al., Case No. 1:07-cv-2450-JOF.

US District Court, Central District of California, Southern Division, *Innovage LLC v. Silverlit Toys Manufactory, Ltd*., et al., Case No. SACV07-1334 DOC (ANx).

"Declaration of Alexander Van De Rostyne in Support of Defendants and Counterclaimants Silverlit Toys Manufactory Ltd.'s and Spin Master Ltd.'s Motion for Preliminary Injunction", with relevant Exhibits A, C and E-Q, filed on Dec. 3, 2007, in USDC Case No. SACV07-1334 DOC (ANx).

"Declaration of Kei Fung ("Kevin") Choi in Support of Defendants and Counterclaimants' Motion for Preliminary Injunction", with relevant Exhibits A, C, and E, filed on Dec. 3, 2007, in USDC Case No. SACV07-1334 DOC (ANx).

"Declaration of L. Kenneth Rosenthal in Support of Counterclaimants Silverlit Toys Manufactory Ltd.'s and Spin Master Ltd.'s Motion for Preliminary Injunction", with relevant Exhibits O, P, S, V, Y, BB, MM and NN, filed on Dec. 3, 2007, in USDC Case No. SACV07-1334 DOC (ANx).

"Memorandum of Points and Authorities in Support of Motion for Preliminary Injunction of Silverlit Manufactory Ltd. and Spin Master Ltd.", filed on Dec. 3, 2007, in USDC Case No. SACV07-1334 DOC (ANx).

"Declaration of Valerie W. Ho in Support of Defendants and Counterclaimants' Motion for Preliminary Injunction", with relevant Exhibits A, B and M, filed on Dec. 3, 2007, in USDC Case No. SACV07-1334 DOC (ANx).

"Declaration of Conor Forkan in Support of Counterclaimants Silverlit Toys Manufactory Ltd.'s and Spin Master Ltd.'s Reply to Innovage's Opposition to Motion for Preliminary Injunction", with relevant Exhibits A-D, filed on Dec. 26, 2007, in USDC Case No. SACV07-1334 DOC (ANx).

"Declaration of L. Kenneth Rosenthal in Support of Counterclaimants Silverlit Toys Manufactory Ltd.'s and Spin Master Ltd.'s Reply to Innovage's Opposition to Motion for Preliminary Injunction", with relevant Exhibits A-D, filed on Dec. 26, 2007, in USDC Case No. SACV07-1334 DOC (ANx).

"Counterclaimants Silverlit Toys Manufactory Ltd.'s and Spin Master Ltd.'s Reply in Support of Motion for Preliminary Injunction", filed on Dec. 26, 2007, in USDC Case No. SACV07-1334 DOC (ANx).

"Innovage's Memorandum of Points and Authorities in Opposition to Silverlit and Spin Master's Motion for Preliminary Injunction", filed on Dec. 19, 2007, in USDC Case No. SACV07-1334 DOC (ANx).

"Declaration of Francisco Rubio-Campos in Support of Plaintiff Innovage LLC's Opposition to Silverlit and Spin Master's Motion for Preliminary Injunction", filed on Dec. 19, 2007, in USDC Case No. SACV07-1334 DOC (ANx).

"Declaration of Jennifer Hamilton in Support of Plaintiff Innovage LLC's Opposition to Silverlit and Spin Master's Motion for Preliminary Injunction", filed on Dec. 19, 2007, in USDC Case No. SACV07-1334 DOC (ANx).

"Counterclaim Defendant Merchsource's Opposition to Preliminary Injunction", filed on Dec. 19, 2007, in USDC Case No. SACV07-1334 DOC (ANx).

"Declaration of Lowell Anderson in Opposition to Preliminary Injunction", filed on Dec. 19, 2007, in USDC Case No. SACV07-1334 DOC (ANx).

"Supplemental Declaration of Francisco Rubio-Campos in Support of Plaintiff Innovage LLC's Opposition to Silverlit and Spin Master's Motion for Preliminary Injunction", filed on Jan. 4, 2008, in USDC Case No. SACV07-1334 DOC (ANx).

"Declaration of Nicholas Ringold in Support of Defendants and Counterclaimants' Reply to Merchsource LLC's Opposition to Ex Parte Application to Shorten Time for Hearing on Preliminary Injunction", with relevant Exhibits B-I, filed on Dec. 5, 2007, in USDC Case No. SACV07-1334 DOC (ANx).

"Declaration of Kei Fung ("Kevin") Choi in Support of Defendants and Counterclaimants' Reply to Merchsource LLC's Opposition to Ex Parte Application to Shorten Time for Hearing on Preliminary Injunction", with Exhibit A, filed on Dec. 6, 2007, in USDC Case No. SACV07-1334 DOC (ANx).

"Counterclaimants Silverlit Toys Manufactory Ltd.'s and Spin Master's Reply to Merchsource LLC's Opposition to Ex Parte Application to Shorten Time on Hearing on Motion for Preliminary Injunction", filed on Dec. 6, 2007, in USDC Case No. SACV07-1334 DOC (ANx).

"Counterclaimants Silverlit Toys Manufactory Ltd.'s and Spin Master's 1) Reply to Innovage LLC's Opposition to Ex Parte Application to Shorten Time on Hearing on Motion for Preliminary Injunction, and 2) Opposition to Innovage LLC's Ex Parte Application for Order to Extend Time to Oppose Motion for Preliminary Injunction", filed on Dec. 5, 2007, in USDC Case No. SACV07-1334 DOC (ANx).

"Declaration of Lowell Anderson in Opposition to Ex Parte Application to Shorten Time for Hearing on Preliminary Injunction", filed on Dec. 4, 2007, in USDC Case No. SACV07-1334 DOC (ANx).

"Counterclaim Defendant Merchsource's Opposition to Ex Parte Application to Shorten Time for Hearing on Motion for Preliminary Injunction", filed on Dec. 4, 2007, in USDC Case No. SACV07-1334 DOC (ANx).

"Plaintiff Innovage LLC's Opposition to Defendant Silverlit and Spin Master's Ex Parte Application for Order to Shorten Time for Hearing on Defendants' Motion for Preliminary Injunction; Declaration of Barry Messner in Support", filed on Dec. 4, 2007, in USDC Case No. SACV07-1334 DOC (ANx).

"Plaintiff Innovage LLC's Ex Parte Application for Order to Extend Time to Oppose Defendants' Motion for Preliminary Injunction; Memorandum of Points and Authorities; Declaration of Barry Messner", filed on Dec. 4, 2007, in USDC Case No. SACV07-1334 DOC (ANx).

"Amended Answer, Affirmative Defenses and Counterclaims for: (1) Patent Infringement; (2) Trade Dress Infringement; (3) Unfair Competition and False Designation of Origin; (4) Unfair Competition Under California Business & Professions Code § 17200; and (5) Copyright Infringement", filed on Dec. 11, 2007, in USDC Case No. SACV07-1334 DOC (ANx).

"Innovage's Reply in Opposition of Silverlit and Spin Master to Plaintiff Innovage LLC's Ex Parte Application for Order to Extend Time to Oppose Defendants' Motion for Preliminary Injunction", filed on Dec. 7, 2007, in USDC Case No. SACV07-1334 DOC (ANx).

"Counterclaim Defendant Innovage LLC's Amended Reply and Affirmative Defenses to Counterclaims of Silverlit Toys Manufactory Ltd. and Spin Master Ltd.", filed on Jan. 9, 2008, in USDC Case No. SACV07-1334 DOC (ANx).

"*Order* Denying Defendants' Motion for Preliminary Injunction", filed on Jan. 8, 2008, in USDC Case No. SACV07-1334 DOC (ANx).

"Counterclaimants Silverlit Toys Manufactory Ltd.'s and Spin Master's Ltd.'s Objection and Motion to Strike Plaintiff Innovage LLC's Belated Supplemental Declaration of Francisco Rubio-Campos", filed on Jan. 4, 2008, in USDC Case No. SACV07-1334 DOC (ANx).

"Supplemental Declaration of Francisco Rubio-Campos in Support of Plaintiff Innovage LLC's Opposition to Silverlit ad Spin Master's Motion for Preliminary Injunction", filed on Jan. 4, 2008, in USDC Case No. SACV07-1334 DOC (ANx).

"Counterclaim Defendant Innovage LLC's Reply and Affirmative Defenses to Counterclaims of Silverlit Toys Manufactory Ltd. and Spin Master Ltd.", filed on Dec. 26, 2007, in USDC Case No. SACV07-1334 DOC (ANx).

"Counterclaim Defendant Merchsource LLC's Answer and Defenses to Counterclaims of Silverlit Toys Manufactory Ltd. and Spin Master Ltd.", filed on Dec. 26, 2007, in USDC Case No. SACV07-1334 DOC (ANx).

"Answer, Affirmative Defenses and Counterclaims for: (1) Patent Infringement; (2) Trade Dress Infringement; (3) Unfair Competition and False Designation of Origin; and (4) Unfair Competition Under California Business & Professions Code § 17200", with Exhibits E & F, filed on Dec. 3, 2007, in USDC Case No. SACV07-1334 DOC (ANx).

"Complaint for: 1) Declaratory Judgment of Invalidity and Non-Infringement of Certain Design Patents; 2) Declaratory Judgment of Invalidity and Non-Infringement of Trade Dress", filed on Nov. 13, 2007, in USDC Case No. SACV07-1334 DOC (ANx).

Photo of portion of PicooZ product package; Silverlit 2006 Product Catalog (5 pages total).

Partial International Search from PCT/US2006/047982.

Photographic prior art reference #1, helicopter.

Photographic prior art reference #2, helicopter displaying writing in French on the tail.

Photographic prior art reference #3, explanation of the function of the flybar.

Photographic prior art reference #4, toy helicopter, www.raidentech.com.

Photographic prior art reference #5, toy helicopter.

Photographic prior art reference #6, helicopter.

Photographic prior art reference #7, helicopter with M40297 or MA0297 displayed on the tail.

Photographic prior art reference #8, toy helicopter #AHS-23900, hstoy.en.alibaba.com.

Photographic prior art reference #9, toy helicopter, toys999.en.alibaba.com.
Mill, Colin. "Practical Theories, Part 9", W3MH—World Wide Web *Model Helicopter Magazine*, Jul. 1996, http://www.w3mh.co.uk/articles/html/csm9-11.htm.
Day, David. "Moving swashplates & CCPM", 2001-2006. See http://www.iroquois.free-online.co.uk.
Photographic prior art reference, Dragonfly helicopter (4 pages).
Piccolino: 1.69 gram RC helicopter—RCGroups.com, http://www.rcgroups.com/forums/showthread.php?t=509295 (6 pages).
International Search from PCT/US2008/051938.
Pryun, Richard R. "In-flight measurement of rotor blade airloads, bending moments, and motions, together with rotor shaft loads and fuselage vibration, on a tandem rotor helicopter", *Boeing*, Nov. 1967 (Abstract, 1 pg).
Brahmananda, et al. "Application of passive dampers to modern helicopters", Smart Mater, 1996 http://www.iop.org/EJ/abstract/0964-1726/5/5/001 (Abstract, 1 pg).
http://www.microhelicopters.net (3 pgs).
Castillo, et al. "Real-time stabilization and tracking of a four-rotor mini rotorcraft", IEEE, Jul. 2004 http://www.ieeexplore.org/xpl/freeabs_all.jsp?arnumber=1308180 (1 pg).
"Structural Components, Design of Tilt-Rotor JVX Near Completion", Aviation Week & Space Technology, vol. 122, No. 2, p. 84, Jan. 14, 1985 (10 pgs).
European Search Opinion dated Jun. 10, 2008, in EP 06 845 583.1.
Website reference, en.wikipedia.org/wiki/Kamov_Ka-50, Kamov Ka-50, Jun. 19, 2004 (6 pages).
Photographic reference, en.wikipedia.org/wiki/Image:Kamov_Ka-50_MAKS-2005.jpg, Aug. 28, 1995.
Photographic reference, www.fas.org/man/dod-101/sys/ac/row/ka-50-hokum.jpg, Aug. 28, 1995.
Photographic reference, www.aviastar.org/foto/ka-50_1.jpg, Aug. 28, 1995.
Website reference, web.archive.org/web/20050225044931/http://www.silverlit.com (2 pages), Jun. 5, 2007.
Website reference, web.archive.org/web/20060616140712/boeing.com/rotorcraft/military/ah64d/index.htm, Nov. 23, 2001 (2 Pages).
Website reference, en.wikipedia.org/wiki/AH-64_Apache, Jul. 16, 2004 (11 pages).
Website reference, http://www.globalsecurity.org/military/systems/aircraft/ah-64d.htm, Nov. 7, 2001 (6 pages).
Photographic reference, www.fas.org/man/dod-101/sys/ac/ah-64.gif, Aug. 19, 2000.
Photographic reference, en.wikipedia.org/wiki/Image:P320007.jpg, 1981 (3 pages).
Photographic reference, www.fas.org./man/dod-101/sys/ac/ah-64d_001.jpg, Mar. 21, 1997.
Photographic reference, www.fas.org./man/dod-101/sys/ac/ah-64d-image83.jpg, Aug. 19, 2000.
Photographic reference, www.fas.org./man/dod-101/sys/ac/ah-64d-longbow1.jpg, Aug. 19, 2000.
Photographic reference, www.fas.org/man/dod-101/sys/ac/ah-64-dvic294.jpg, Feb. 2, 2003.
Photographic reference, www.voodoo.cz/ah64/pics/ah115.jpg, Jun. 14, 2001.
Photographic reference, www.voodoo.cz/ah64/pics/ah122.jpg, Jan. 10, 2002.
Photographic reference, www.voodoo.cz/ah64/pics/ah106.jpg, Jan. 9, 2002.
Photographic reference, www.voodoo.cz/ah64/pics/ah112.jpg, Aug. 22, 2002.
Photographic reference, www.voodoo.cz/ah64/pics/ah092.jpg, Jan. 8, 2002.
Photographic reference, www.voodoo.cz/ah64/pics/ah153.jpg, Apr. 4, 2002.
Photographic reference, www.voodoo.cz/ah64/pics/ah149.jpg, Jul. 8, 2000.
Photographic reference, www.voodoo.cz/ah64/pics/ah051.jpg, Jan. 8, 2002.
Photographic reference, www.voodoo.cz/ah64/pics/ah049.jpg, Mar. 15, 2002.
Photographic reference, www.voodoo.cz/ah64/pics/ah027.jpg, May 8, 1999.
Photographic reference, www.voodoo.cz/ah64/pics/ah010.jpg, Jul. 8, 2000.
Photographic reference, www.voodoo.cz/ah64/pics/ah003.jpg, Sep. 1, 2001.
Photographic reference, www.airforceworld.com/heli/gfx/ah64/wah64_1.jpg, 1991.
Photographic reference, www.fas.org/man/dod-101/sys/ac/ah-64a-990421-F-2095R-004.jpg, Aug. 19, 2000.
Photographic reference, www.fas.org/man/dod-101/sys/ac/ah-64-dvic292.jpg, Aug. 19, 2000.
Website reference, www.runryder.com/helicopter/t285494p1/, Jun. 12, 2007 (10 pages).
Website reference, web.archive.org/web/20031218200732/http://www.scarlet.be/pixel/pixeli111.htm, Dec. 18, 2003 (7 pages).
Website reference, web.archive.org/web/20031017234927/http://www.scarlet.be/pixel/pixelfp.htm, Oct. 17, 2003 (2 pages).
Website reference, web.archive.org/web/20031218061901/http://pixelito.reference.be/, Dec. 18, 2003 (4 pages).
Website reference, www.aviastar.org/helicopters_eng/breguet-dorand.php, 1935 (4 pages).
Website reference, www.lionheartcreations.com/Lionheartsflightsimsite_page7.html, May 6, 2004 (4 pages).
Website reference, www.lionheartcreations.com/FalconE.html, Jun. 22, 2004 (2 pages).
Photographic reference, www.rotaryaction.com/images/airwolf4.jpg, 1984.
Website reference, www.rotaryaction.com/pages/airwolf.html, 1984 (3 pages).
Website reference, http://www.youtube.com/watch?v=DsXgmOurwts, "Golden Age Pioneers—Nicolas Florine", Mar. 28, 2008 (4 pages).
Robert Dingemanse, Press Release "Flying Car Company Takes Off", Mar. 2007, http://www.pal-v.com.
"Esky Dauphin 4-channels Mini Electric Coaxial Helicopter", http://www.esky-heli.com/esky-24g-4ch-dauphin-bluegrey-rtf-kit-for-beginner-flightsim-p-2994.html, May 8, 2008.

* cited by examiner 19
18
21
22
20
24
26
27
6
23
25

1
F5
6
16
108
12
3
39
31
37
15
28
8
102
35
F2
5
106
36
28
31
104
33-34
39
32
100
4
7
2
12
RADIO CONTROL UNIT

HELICOPTER

RELATED APPLICATION

This application is a Continuation of U.S. patent application Ser. No. 11/754,752, filed Jun. 14, 2007, which is a Divisional of U.S. patent application Ser. No. 11/465,781 filed on Aug. 18, 2006, which is a Continuation-in-Part of U.S. patent application Ser. No. 11/462,177, filed on Aug. 3, 2006 and entitled HELICOPTER, which claims priority to Belgian Patent Application No. 2006/0043 entitled AUTO-STABIELE HELICOPTER by Alexander VAN DE ROSTYNE, which was filed on Jan. 19, 2006. The contents of these applications are incorporated by reference herein.

BACKGROUND

The present disclosure concerns an improved helicopter.

The disclosure concerns a helicopter generally. In particular, but not exclusively, it is related to a toy helicopter and in particular to a remote-controlled model helicopter or a toy helicopter.

SUMMARY

It known that a helicopter is a complex machine which is unstable and as a result difficult to control, so that much experience is required to safely operate such helicopters without mishaps.

Typically, a helicopter includes a body, a main rotor and a tail rotor.

The main rotor provides an upward force to keep the helicopter in the air, as well as a lateral or forward or backward force to steer the helicopter in required directions. This can be by making the angle of incidence of the propeller blades of the main rotor vary cyclically at every revolution of the main rotor.

The main rotor has a natural tendency to deviate from its position, which may lead to uncontrolled movements and to a crash of the helicopter if the pilot loses control over the steering of the helicopter.

Solutions to slow down the effect have already been provided up to now, including the application of stabilizing rods and weights at the tips of the propeller blades.

All these solutions make use of the known phenomenon of gyroscopic precession caused by the Coreolis force and the centrifugal forces to obtain the desired effect.

The tail rotor is not at all insensitive to this phenomenon, since it has to prevent the body from turning around the drive shaft of the rotor as a result of the resistance torque of the rotor on the body.

To this end, the tail rotor is erected such that it develops a lateral thrust which has to counteract the above-mentioned resistance torque of the rotor and the helicopter is provided with means which have to enable the pilot to control the lateral thrust so as to determine the flight position round the vertical axis.

Since the tail of the helicopter tends to turn round the drive shaft of the main rotor, even in case of small variations in the drive torque of the main rotor, most helicopters are provided with a separate and autonomous mechanical or electromechanical system such as a gyroscope or the like which automatically compensates the thrust of the tail rotor for the unwanted rotations.

In general, the stability of a helicopter includes the result of the interaction between:

the rotation of the rotor blades; the movements of any possible stabilizing rods; compensation of the resistance torque of the main rotor by means of the tail rotor;

the system such as a gyroscope or the like to compensate for small undesired variations in the resistance torque of the main rotor; and control of the helicopter which controls the rotational speed of the main rotor and of the tail rotor.

When these elements are essentially in balance, the pilot should be able to steer the helicopter as desired.

This does not mean, however, that the helicopter can fly by itself and can thus maintain a certain flight position or maneuver, for example, hovering or making slow movements without the intervention of a pilot.

Moreover, flying a helicopter usually requires intensive training and much experience of the pilot, for both a full size operational real helicopter as well as a toy helicopter or a remote-controlled model helicopter.

The present disclosure aims to minimize one or several of the above-mentioned and other disadvantages by providing a simple and cheap solution to auto stabilize the helicopter, such that operating the helicopter becomes simpler and possibly reduces the need for long-standing experience of the pilot.

The helicopter should meet the following requirements to a greater or lesser degree:

(a) it can return to a stable hovering position, in case of an unwanted disturbance of the flight conditions. Such disturbance may occur in the form of a gust of wind, turbulences, a mechanical load change of the body or the rotors, a change of position of the body as a result of an adjustment to the cyclic variation of the pitch or angle of incidence of the propeller blades of the main rotor or a steering of the tail rotor or the like with a similar effect; and (b) the time required to return to the stable position should be relatively short and the movement of the helicopter should be relatively small.

To this end, the disclosure concerns an improved helicopter including a body with a tail; a main rotor with propeller blades which are driven by a rotor shaft and which are hinge-mounted to the rotor shaft by means of a joint. The angle between the surface of rotation of the main rotor and the rotor shaft may vary. A tail rotor is driven by a second rotor shaft which is directed transversal to the rotor shaft of the main rotor.

The helicopter is provided with an auxiliary rotor which is driven by the shaft of the main rotor and which is provided with two vanes extending essentially in line with their longitudinal axis. The "longitudinal" axis is seen in the sense of rotation of the main rotor, and is essentially parallel to the longitudinal axis of at least one of the propeller blades of the main rotor or is located within a relatively small acute angle with the latter propeller blade axis. This auxiliary rotor is provided in a swinging manner on an oscillatory shaft which is provided essentially transversal to the rotor shaft of the main rotor. This is directed essentially transverse to the longitudinal axis of the vanes. The main rotor and the auxiliary rotor are connected to each other through a mechanical link, such that the swinging motions of the auxiliary rotor control the angle of incidence of at least one of the propeller blades of the main rotor.

In practice, it appears that such an improved helicopter is more stable and stabilizes itself relatively quickly with or without a restricted intervention of the user.

According to different aspects of the disclosure, the helicopter is made more stable by suspending the tail rotor with its rotor shaft in a swing which can rotate round a swing shaft. The swing shaft essentially extends in the longitudinal direction relative to the body of the helicopter.

In case of malfunction or the like, whereby the helicopter starts to turn round the rotor shaft of the main rotor in an unwanted manner, the tail rotor, as a result of the gyroscopic precession acting on the rotating tail rotor as a result of the rotation round the rotor shaft of the main rotor, should tilt round the swing shaft of the tail rotor at a certain angle.

By measuring the relative angular displacement of the swing and by using the measured signal as an input signal for a microprocessor which controls the drive of the main rotor and the drive of the tail rotor as a function of a stabilizer algorithm, the thrust of the tail rotor can be adjusted so as to counteract the unwanted effect of the disturbance and to thus automatically restore the stable flight conditions for the helicopter, with minimal or any intervention of the pilot.

The main rotor with propeller blades is driven by a rotor shaft on which the blades are mounted. The auxiliary rotor is driven by the rotor shaft of the main rotor and is provided with vanes from the rotor shaft in the sense of rotation of the main rotor.

The auxiliary rotor is mounted in a swinging relationship on an oscillatory shaft and the swinging motion being relatively upwardly and downwardly about the auxiliary shaft. The auxiliary shaft is provided essentially transverse to the rotor shaft of the main rotor. The main rotor and the auxiliary rotor are connected to each other by a mechanical link, such that the swinging motion of the auxiliary rotor controls the angle of incidence of at least one of the propeller blades of the main rotor.

The angle of incidence of the rotor in the plane of rotation of the rotor and the rotor shaft may vary; and an auxiliary rotor rotatable with the rotor shaft is for relative oscillating movement about the rotor shaft. Different relative positions are such that the auxiliary rotor causes the angle of incidence the main rotor to be different. A linkage between the main and auxiliary rotor causes changes in the position of the auxiliary rotor to translate to changes in the angle of incidence.

The propeller blades of the main rotor and the vanes of the auxiliary rotor respectively are connected to each other with a mechanical linkage that permits the relative movement between the blades of the propeller and the vanes of the auxiliary rotor.

There are wings directed transversely to a longitudinal axis of the helicopter body directed transversely and downwardly and a downwardly directed stabilizer at the tail of the helicopter. This facilitates stability on the ground.

DRAWINGS

In order to further explain the characteristics of the disclosure, the following embodiments of an improved helicopter according to the disclosure are given as an example only, without being limitative in any way, with reference to the accompanying drawings, in which:

FIG. 1 schematically represents a helicopter according to the disclosure in perspective;

Figure 11:
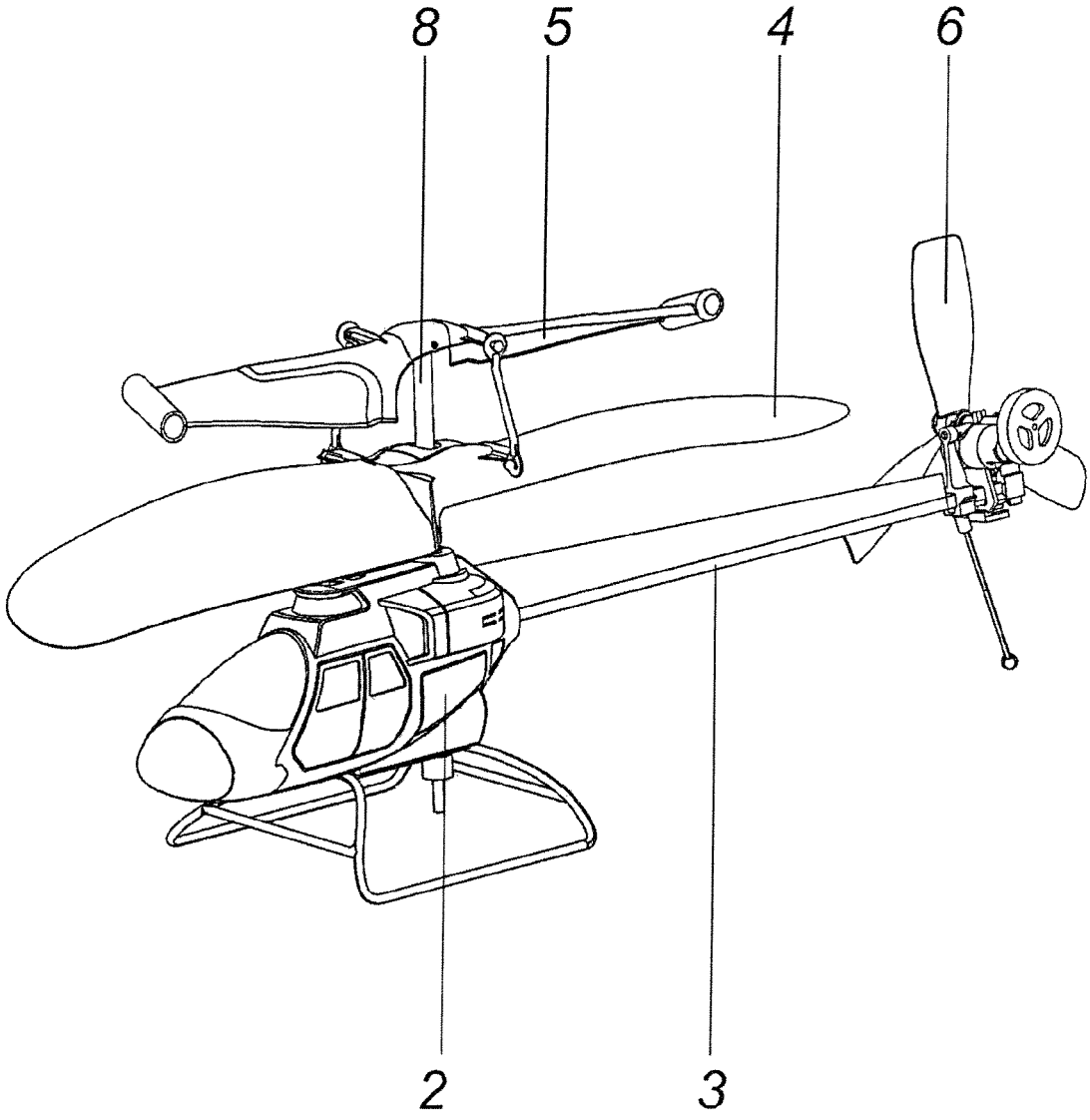
Figure 12:
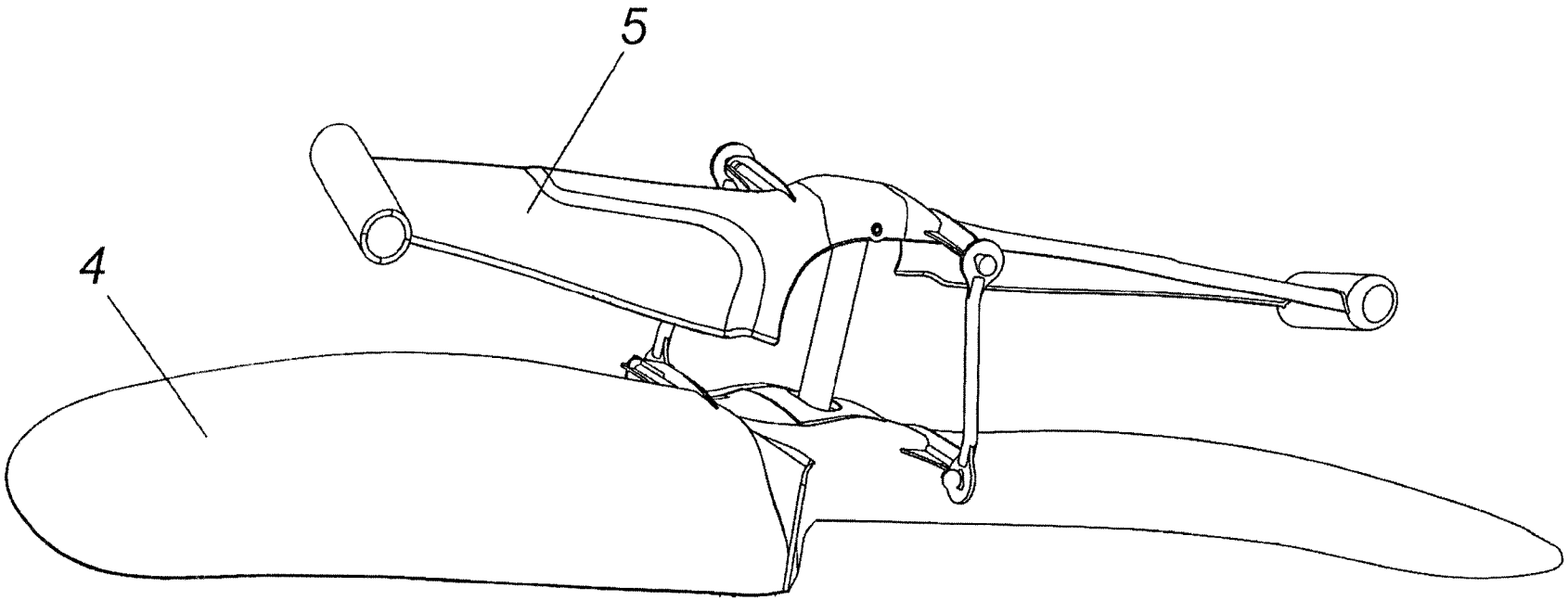
Figure 13:
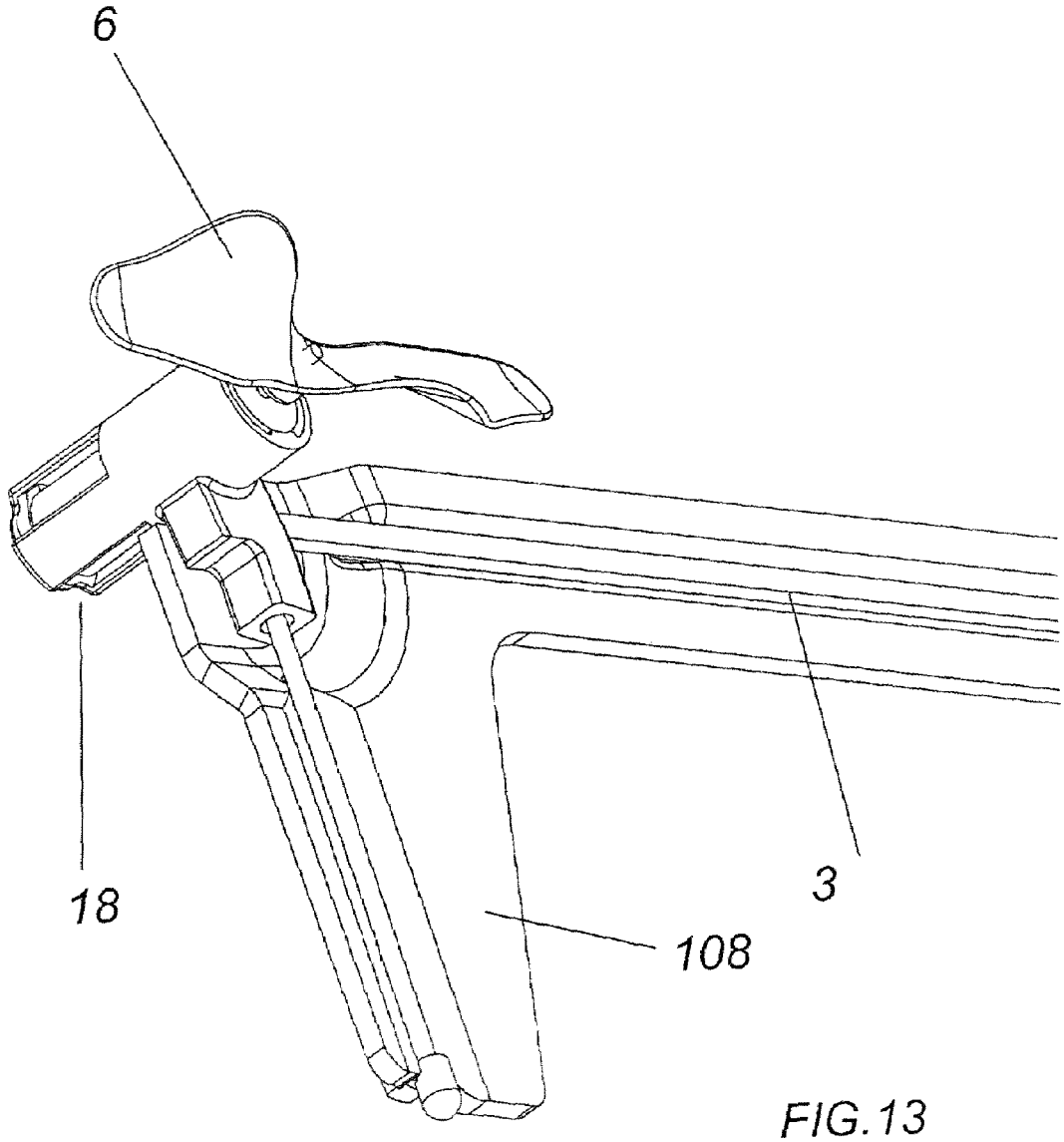
Figure 14:
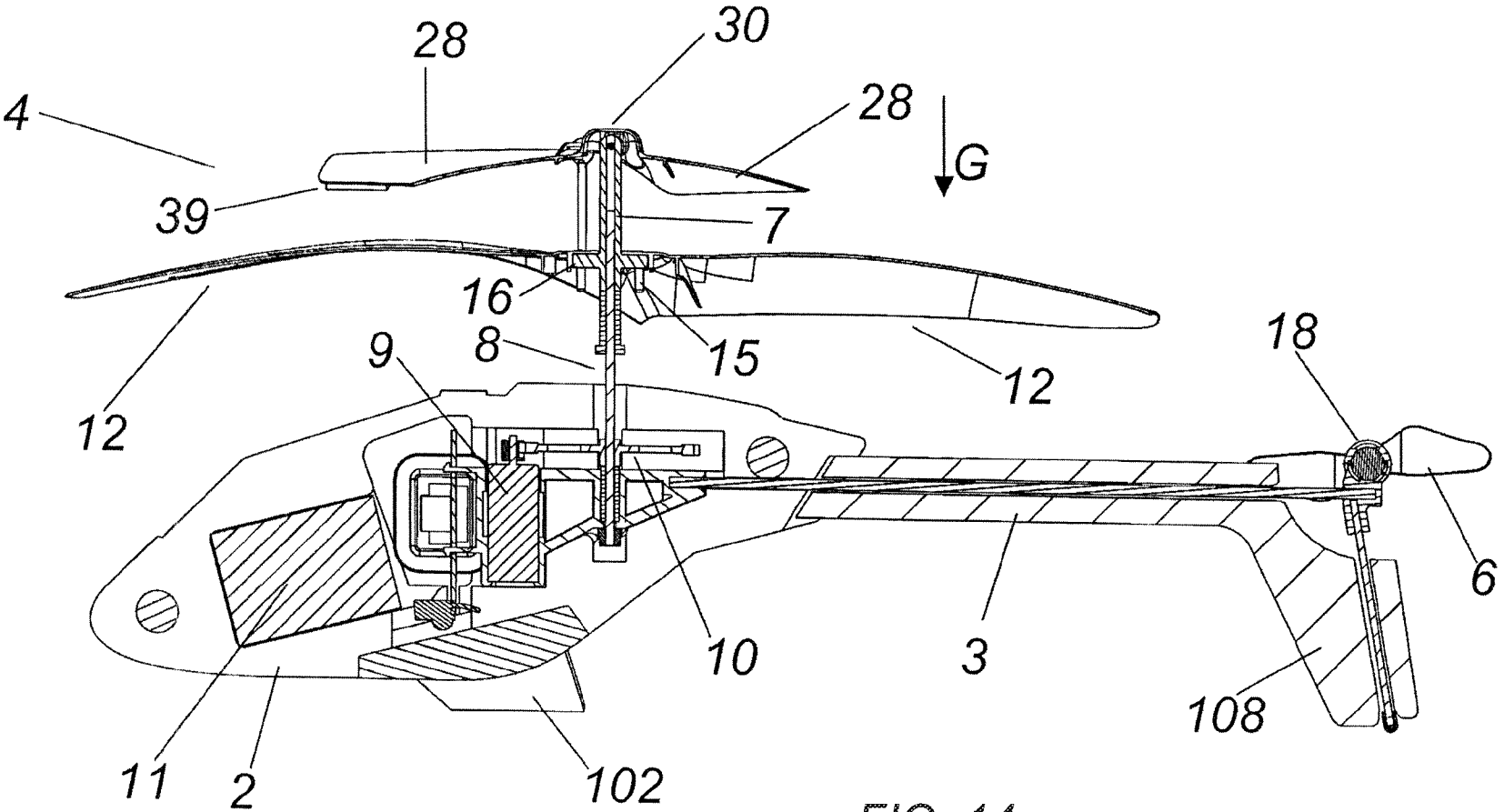
Figure 15:
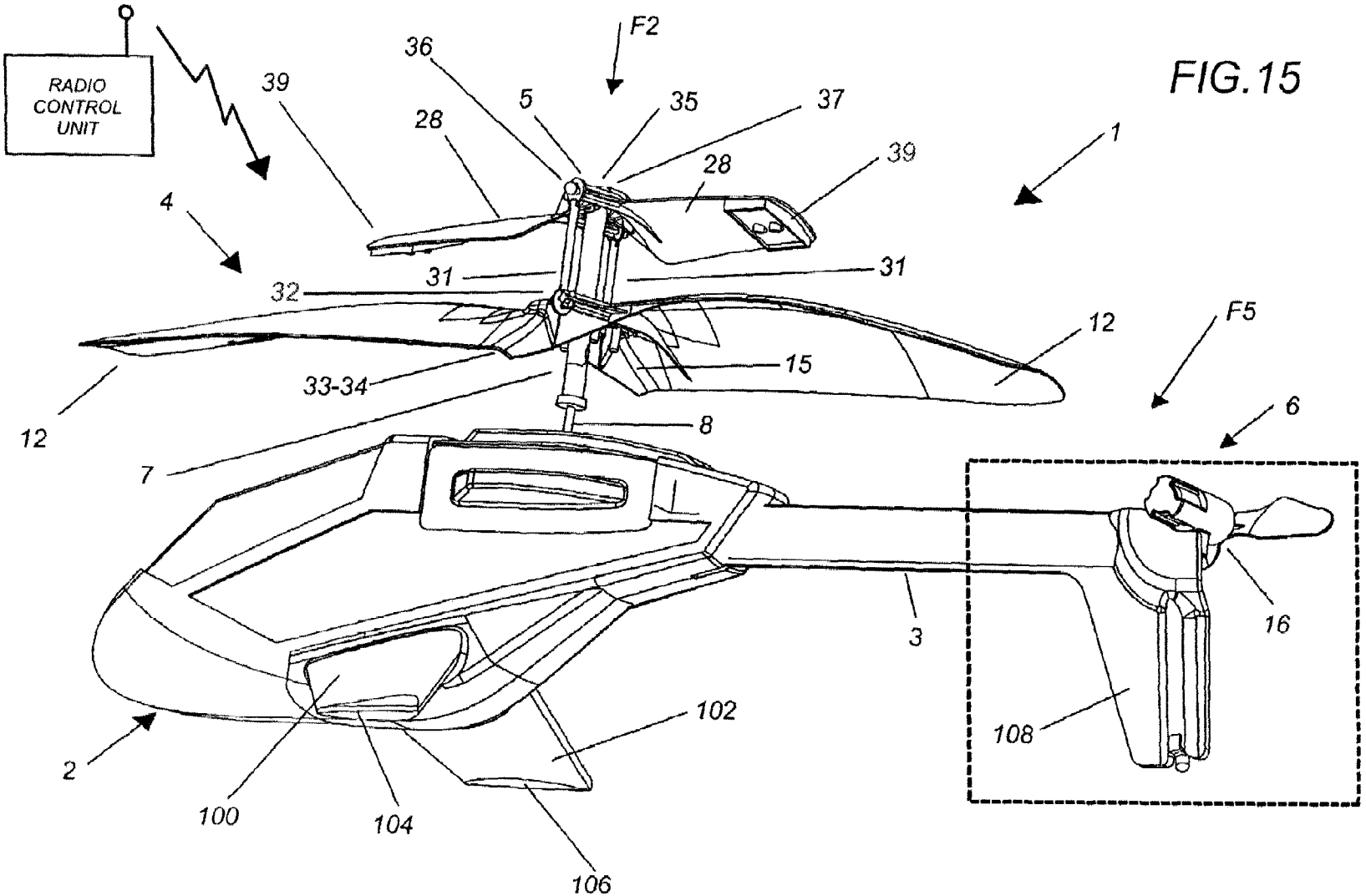
Figure 16:
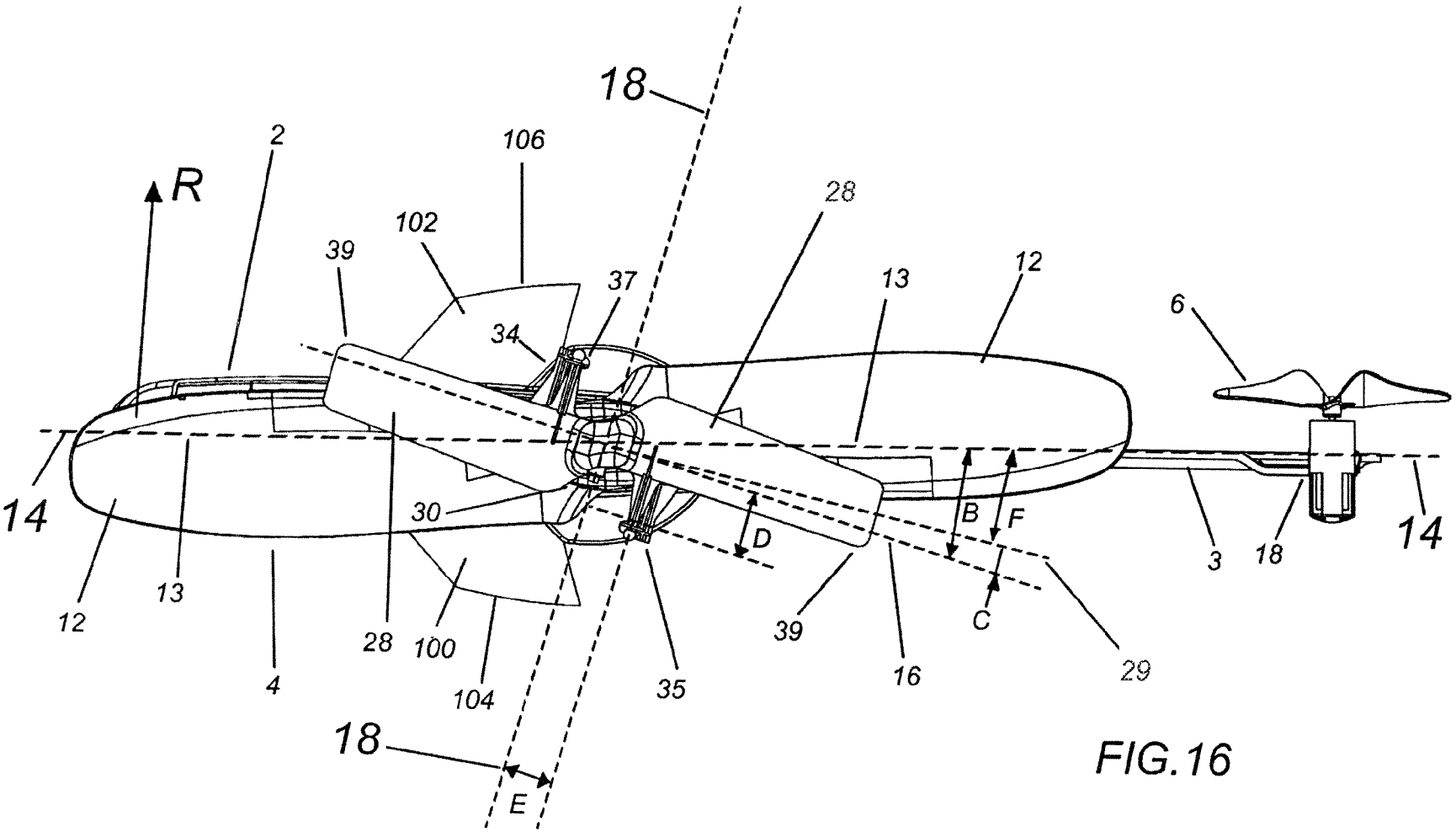
Figure 17:
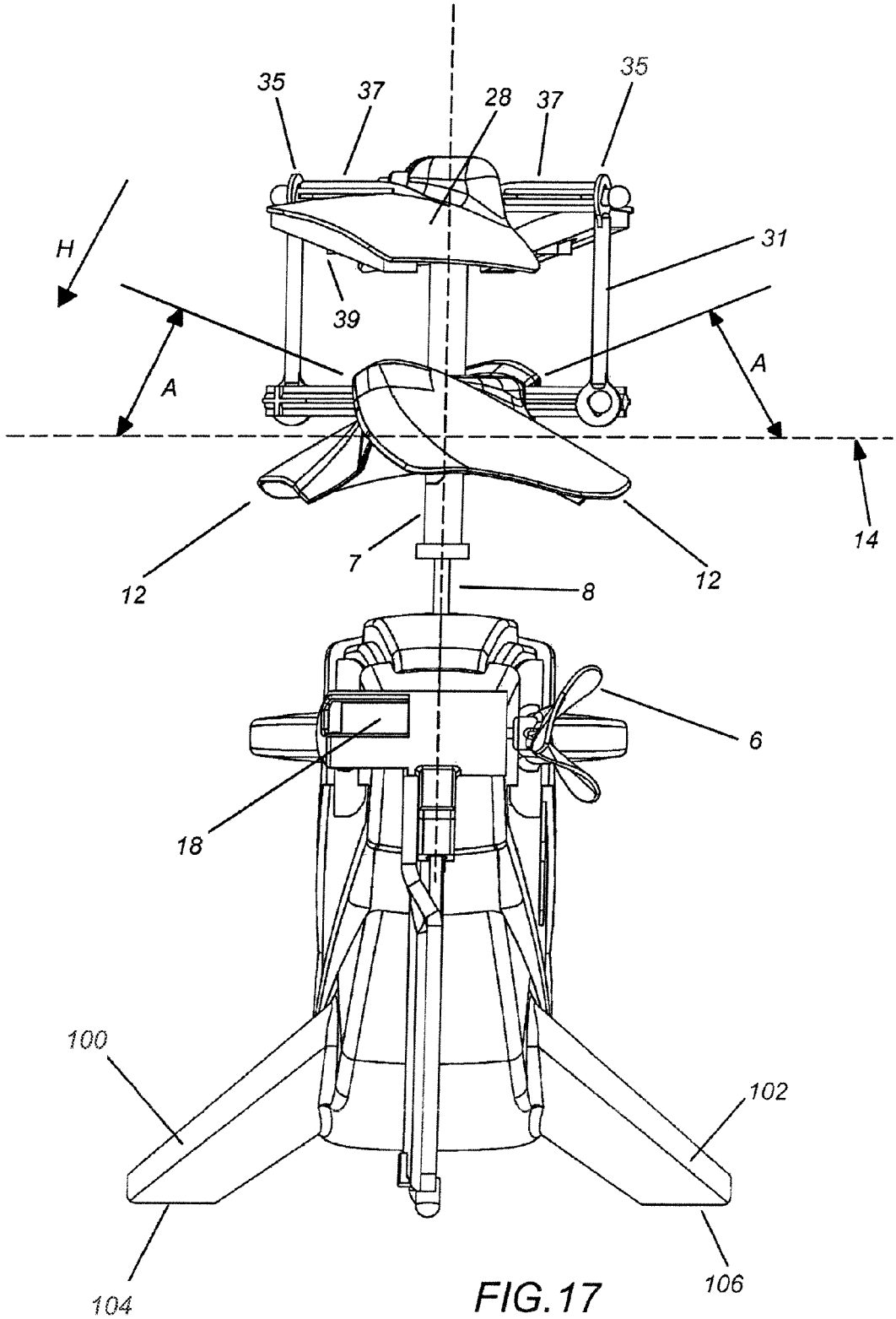
Figure 18:
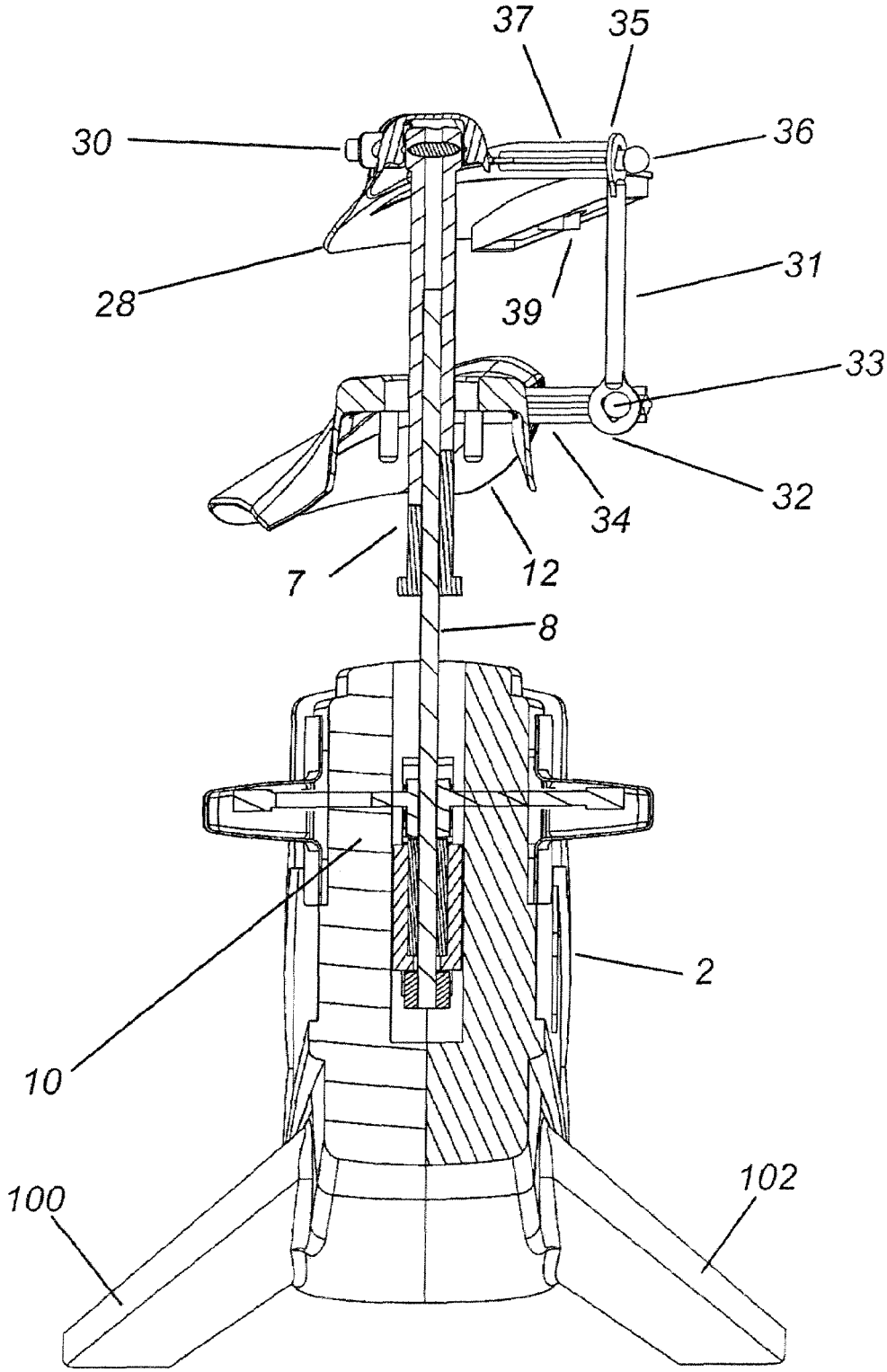

FIG. 11 schematically represents an alternative view of the helicopter according to the disclosure in perspective;

FIG. 12 is a perspective view of the main rotor and auxiliary rotor;

FIG. 13 is a perspective view of the tail rotor and tail stabilizer in a second embodiment of the helicopter;

FIG. 14 represents a side sectional view in the second embodiment of the helicopter;

FIG. 15 represent a perspective view of the second embodiment of the helicopter;

FIG. 16 represents a top view of the second embodiment of the helicopter;

FIG. 17 is a rear view of the second embodiment of the helicopter;

FIG. 18 represents a sectional view of the second embodiment of the helicopter along line 18-18 of FIG. 16.

DETAILED DESCRIPTION

The helicopter 1 represented in the figures by way of example is a remote-controlled helicopter which essentially consists of a body 2 with a landing gear and a tail 3; a main rotor 4; an auxiliary rotor 5 driven synchronously with the latter and a tail rotor 6.

The main rotor 4 is provided by means of what is called a rotor head 7 on a first upward directed rotor shaft 8 which is bearing-mounted in the body 2 of the helicopter 1 in a rotating manner and which is driven by means of a motor 9 and a transmission 10, whereby the motor 9 is, for example, an electric motor which is powered by a battery 11.

The main rotor 4 in this case has two propeller blades 12 which are in line or practically in line, but which may just as well be composed of a larger number of propeller blades 12.

Figure 6:
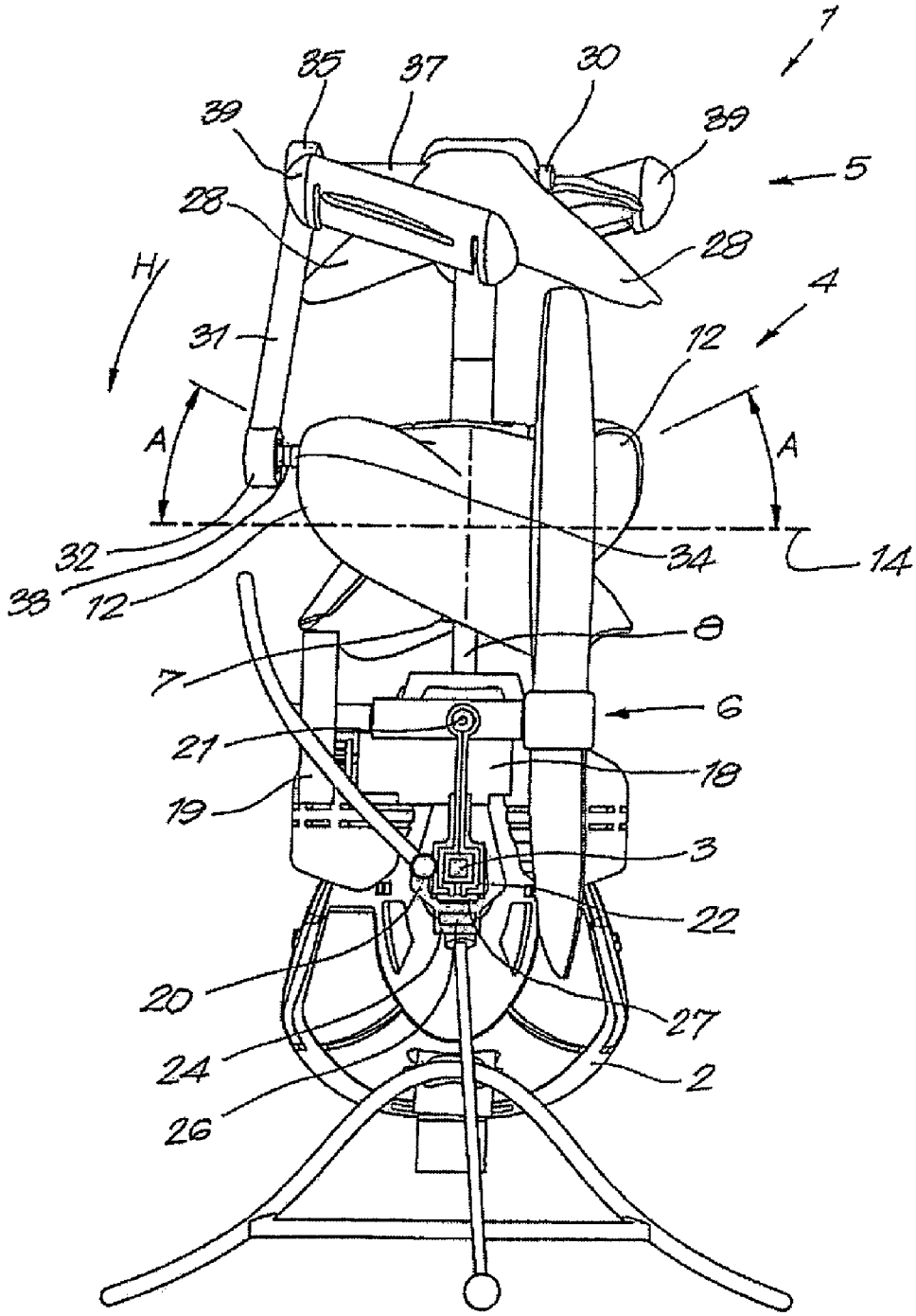
FIG. 6 is a rear view according to arrow F6 in FIG. 5.

The tilt or angle of incidence A of the propeller blades 12, in other words the angle A which forms the propeller blades 12 as represented in FIG. 6 with the plane of rotation 14 of the main rotor 4, can be adjusted as the main rotor 4 is hinge-mounted on this rotor shaft 8 by means of a joint, such that the angle between the plane of rotation of the main rotor and the rotor shaft may freely vary.

In the case of the example of a main rotor 4 with two propeller blades 12, the joint is formed by a spindle 15 of the rotor head 7.

Figure 1:
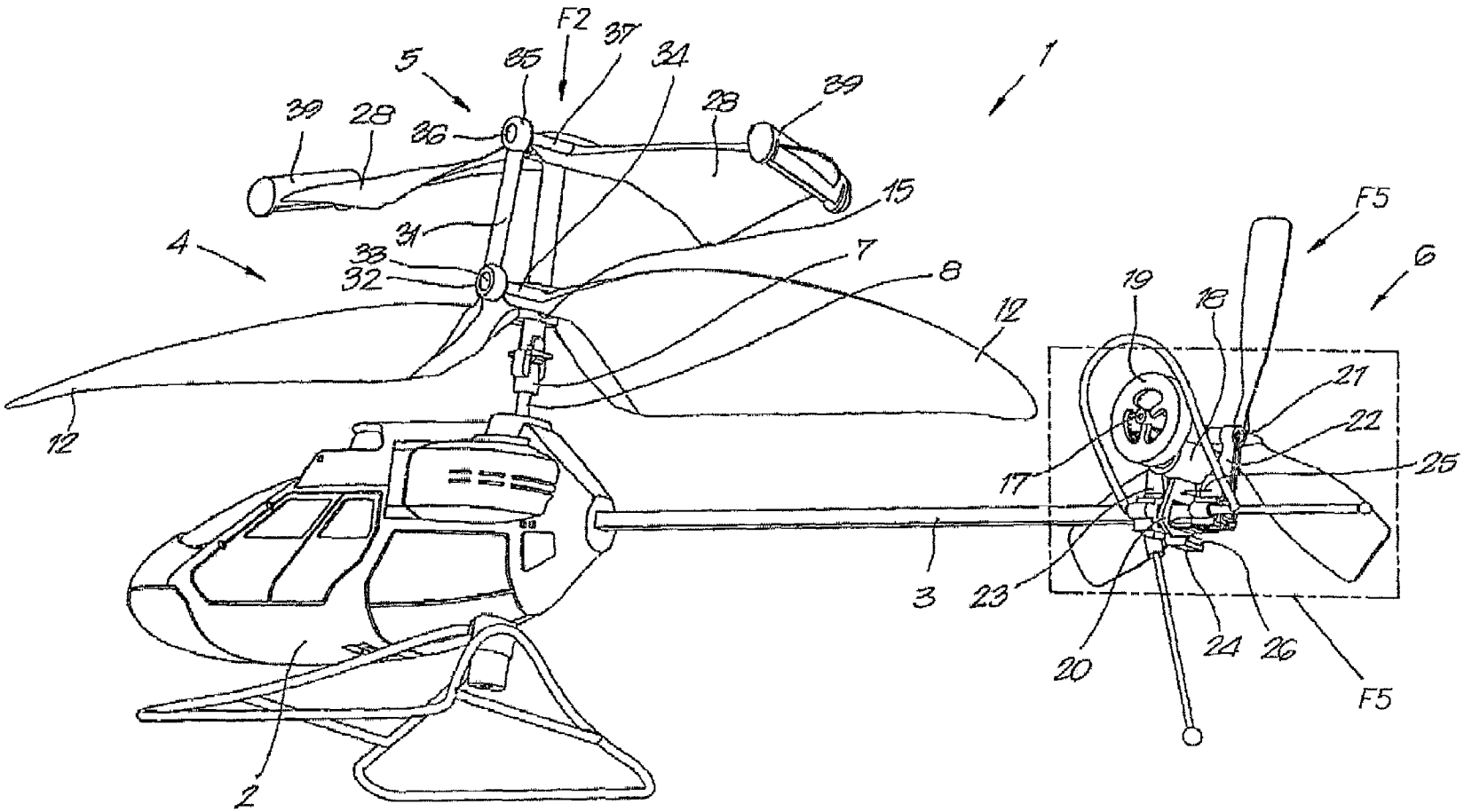
Figure 2:
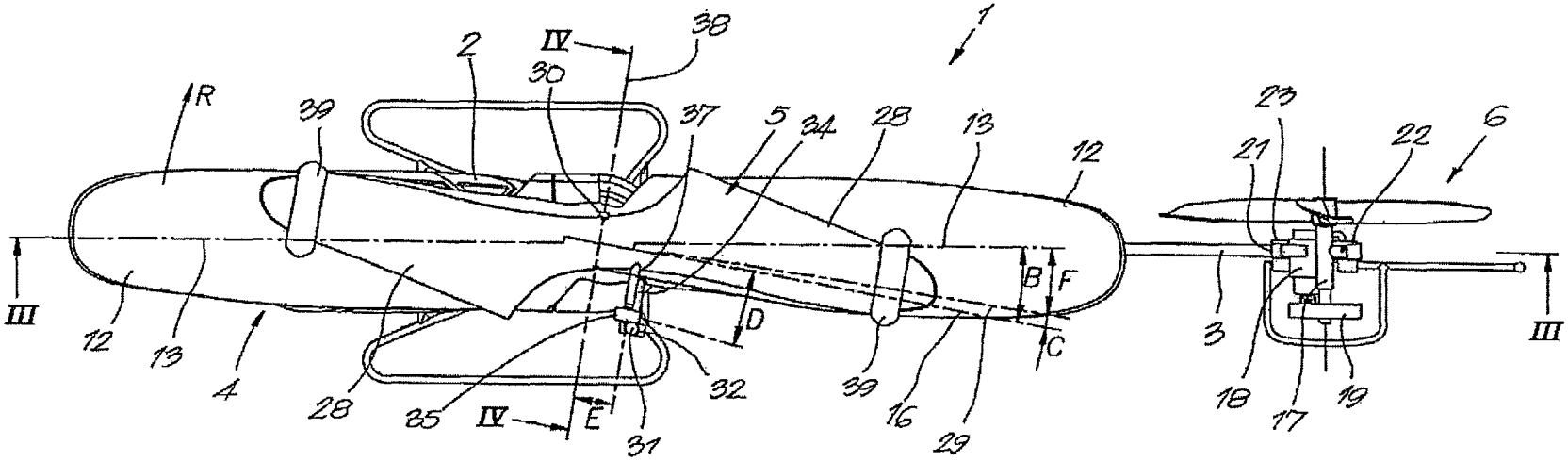
FIG. 2 represents a top view according to arrow F2 in FIG. 1.
Figure 3:
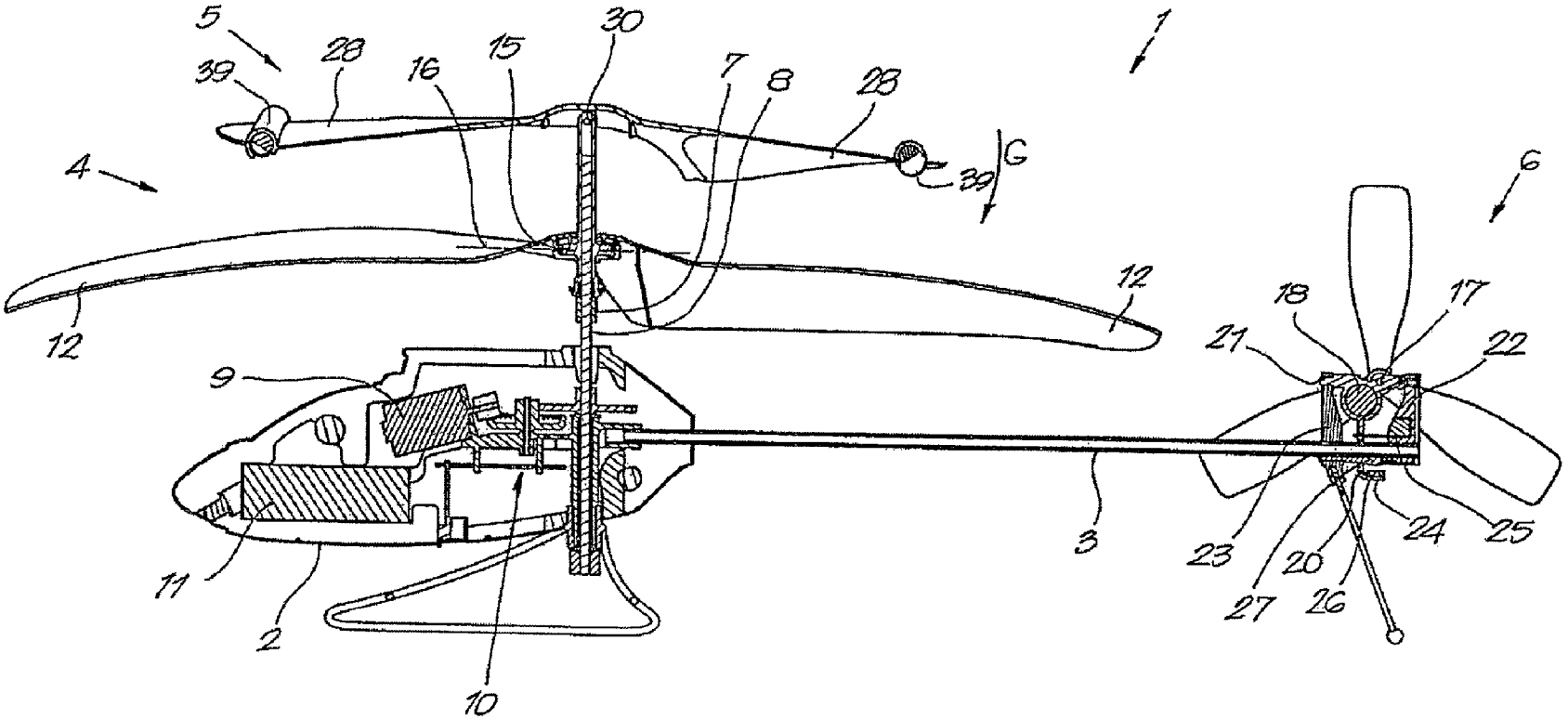
FIGS. 3 and 4 represent respective sections according to lines II-II and III-III in FIG. 2.
Figure 4:
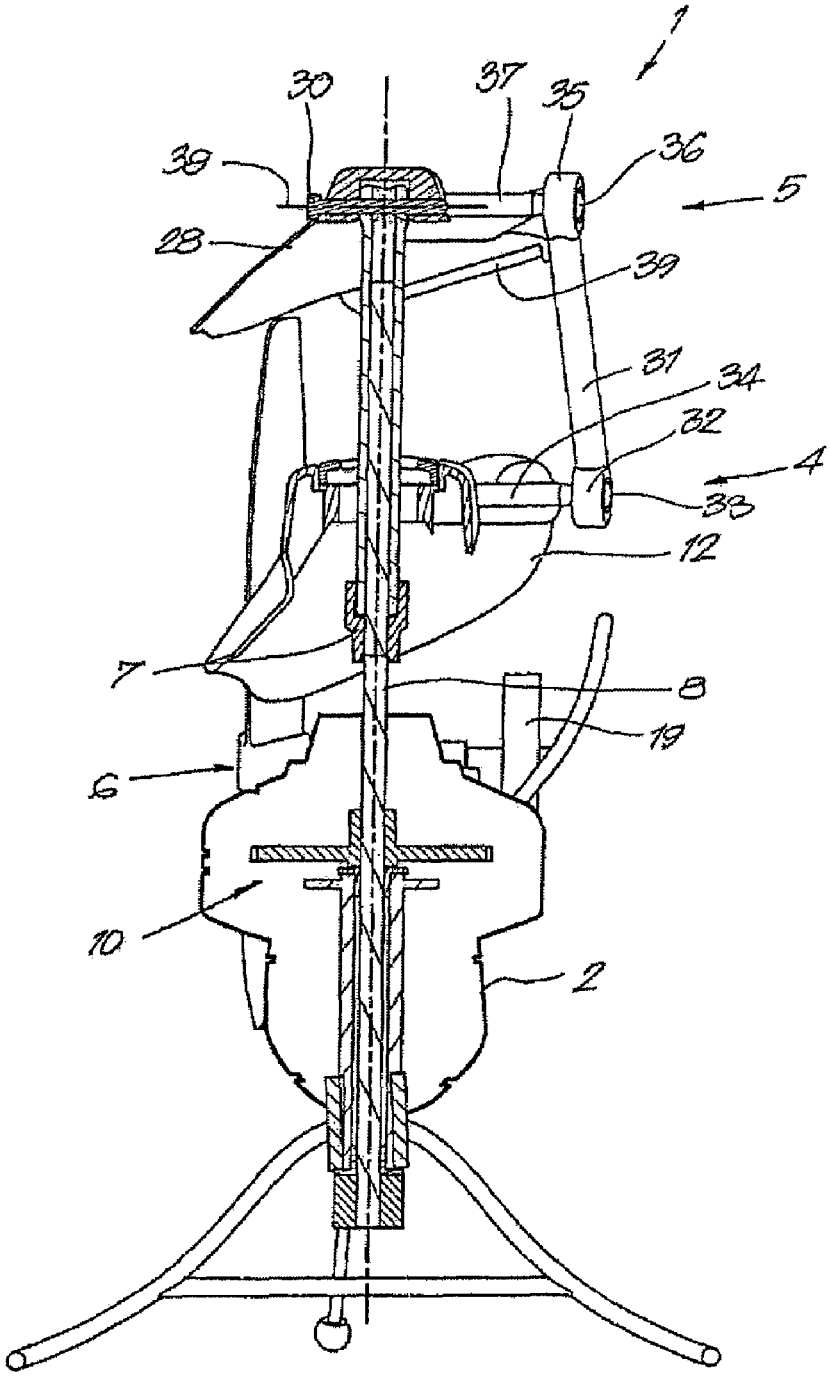
Figure 5:
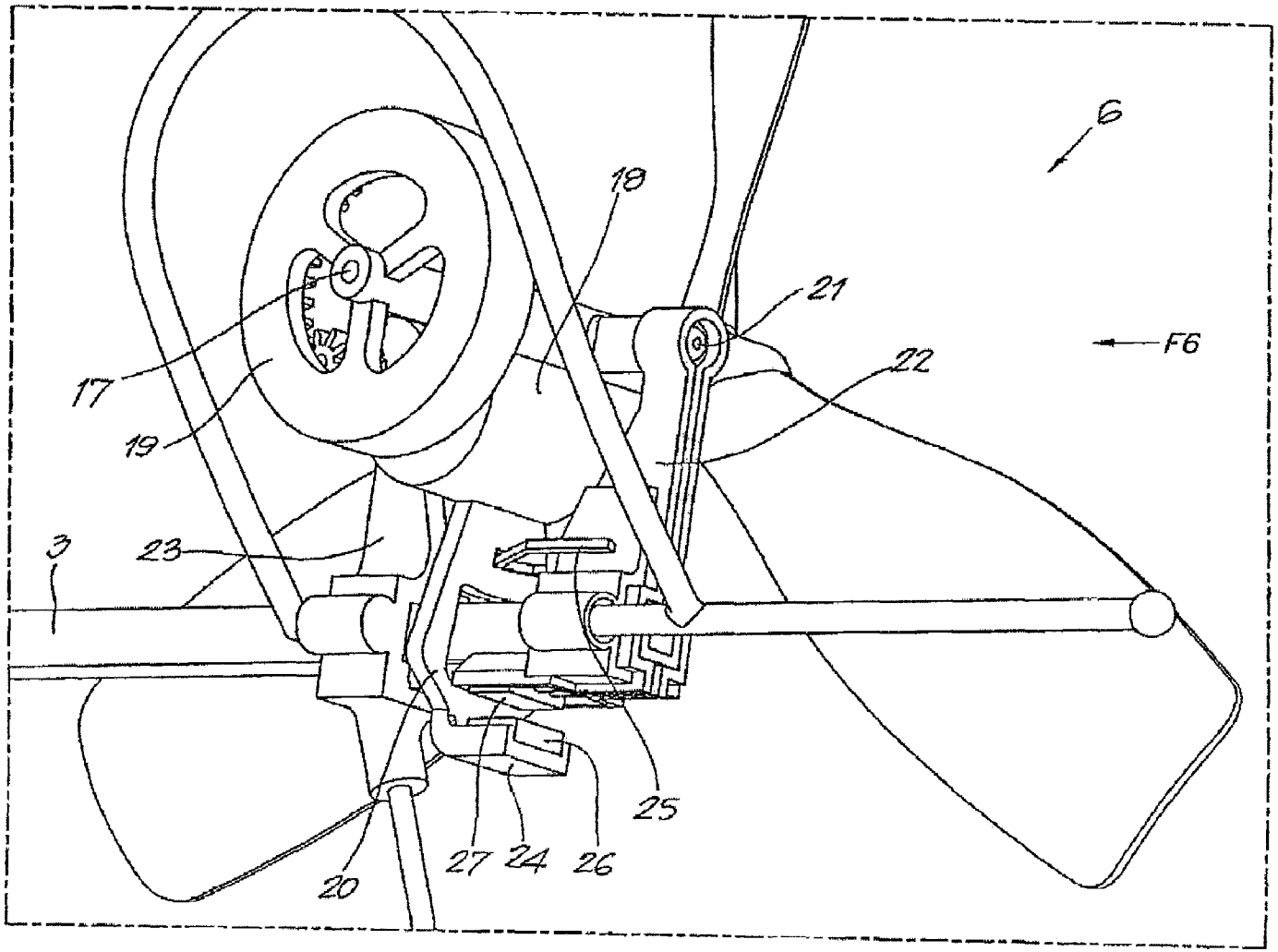
FIG. 5 represents a view of the rear rotor part indicated in FIG. 1 by F5 to a larger scale.

The axis 16 of this spindle 15 is directed transversal to the rotor shaft 8 and essentially extends in the direction of the longitudinal axis 13 of one of the propeller blades 12 and it preferably forms, as represented in FIG. 2, an acute angle B with this longitudinal axis 13.

The tail rotor 6 is driven via a second rotor shaft 17 by means of a second motor 18 and a transmission 19. Motor 16 can be an electric motor. The tail rotor 6 with its rotor shaft 17 and its drive 18-19 is suspended in a swing 20 which can rotate round a swing shaft 21 which is fixed to the tail 3 of the helicopter 1 by two supports 22 and 23.

The swing 20 is provided with an extension piece 24 towards the bottom, which is kept In a central position by means of a spring 25 when in a state of rest, whereby the second rotor shaft 17 in this position is horizontal and directed crosswise to the first rotor shaft 8.

On the lower end of the extension piece 24 of the swing 20 is provided a magnet 26, whereas opposite the position of the magnet 26 in the above-mentioned state of rest of the swing 20 is fixed a magnetic sensor 27 to the tail 3 which makes it possible to measure the relative angular displacement of the swing 20 and thus of the tail rotor 6 round the swing shaft 21.

It is clear that this angular displacement of the swing 20 can also be measured in other ways, for example by means of a potentiometer.

The measured signal can be used as an input signal for a control box, which is not represented in the figures, which controls the drives of the main rotor 4 and of the tail rotor 6 and which is provided with a stabilizer algorithm which will give a counter steering command when a sudden unwanted angular displacement of the tail rotor 6 is measured round the swing shaft 21, resulting from an unwanted rotation of the helicopter 1 round the rotor shaft 8, so as to restore the position of the helicopter 1.

The helicopter 1 is also provided with an auxiliary rotor 5 which is driven substantially synchronously with the main rotor 4 by the same rotor shaft 8 and the rotor head 7.

The main rotor 4 in this case has two vanes 28 which are essentially in line with their longitudinal axis 29, whereby the longitudinal axis 29, seen in the sense of rotation R of the main rotor 4, is essentially parallel to the longitudinal axis 13 of propeller blades 12 of the main rotor 4 or encloses a relatively small acute angle C with the latter, so that both rotors 4 and 5 extend more or less parallel on top of one another with their propeller blades 12 and vanes 28.

The diameter of the auxiliary rotor 5 is preferably smaller than the diameter of the main rotor 4 as the vanes 28 have a smaller span than the propeller blades 12, and the vanes 28 are substantially rigidly connected to each other. This rigid whole forming the auxiliary rotor 5 is provided in a swinging manner on an oscillating shaft 30 which is fixed to the rotor head 7 of the rotor shaft 8. This is directed transversally to the longitudinal axis of the vanes 28 and transversally to the rotor shaft 8.

The main rotor 4 and the auxiliary rotor 5 are connected to each other by a mechanical link which is such of the auxiliary rotor 5 the angle of incidence A of at least one of the propeller blades 12 of the main rotor 4. In the given example this link is formed of a rod 31.

This rod 31 is hinge-mounted to a propeller blade 12 of the main rotor 4 with one fastening point 32 by means of a joint 33 and a lever arm 34 and with another second fastening point 35 situated at a distance from the latter, it is hinge-mounted to a vane 28 of the auxiliary rotor 5 by means of a second joint 36 and a second lever arm 37.

The fastening point 32 on the main rotor 4 is situated at a distance D from the axis 16 of the spindle 15 of the propeller blades 12 of the main rotor 4, whereas the other fastening point 35 on the auxiliary rotor 5 is situated at a distance E from the axis 38 of the oscillatory shaft 30 of the auxiliary rotor 5.

The distance D is preferably larger than the distance E, and about the double of this distance E, and both fastening points 32 and 35 of the rod 31 are situated, seen in the sense of rotation R on the same side of the propeller blades 12 of the main rotor 4 or of the vanes 28 of the auxiliary rotor 5, in other words they are both situated in front of or at the back of the propeller blades 12 and vanes 28, seen in the sense of rotation.

Also preferably, the longitudinal axis 29 of the vanes 28 of the auxiliary rotor 5, seen in the sense of rotation R, encloses an angle F with the longitudinal axis 13 of the propeller blades 12 of the main rotor 4, which enclosed angle F is in the order, of magnitude of about 100, whereby the longitudinal axis 29 of the vanes 28 leads the longitudinal axis 13 of the propeller blades 12, seen in the sense of rotation R. Different angles in a range of, for example, 5° to 25° could also be in order.

The auxiliary rotor 5 is provided with two stabilizing weights 39 which are each fixed to a vane 28 at a distance from the rotor shaft 8.

Further, the helicopter 1 is provided with a receiver, so that it can be controlled from a distance by means of a remote control which is not represented.

As a function of the type of helicopter, it is possible to search for the most appropriate values and relations of the angles B, F and G by experiment; the relation between the distances D and E; the size of the weights 39 and the relation of the diameters between the main rotor 4 and the auxiliary rotor 5 so as to guarantee a maximum auto stability.

The operation of the improved helicopter 1 according to the disclosure is as follows:

In flight, the rotors 4, 5 and 6 are driven at a certain speed, as a result of which a relative air stream is created in relation to the rotors, as a result of which the main rotor 4 generates an upward force so as to make the helicopter 1 rise or descend or maintain a certain height, and the tail rotor 6 develops a laterally directed force which is used to steer the helicopter 1.

It is impossible for the main rotor 4 to adjust itself, and it will turn in the plane 14 in which it has been started, usually the horizontal plane. Under the influence of gyroscopic precession, turbulence and other factors, it will take up an arbitrary undesired position if it is not controlled.

The surface of rotation of the auxiliary rotor 5 may take up another inclination in relation to the surface of rotation 14 of the main rotor 8, whereby both rotors 5 and 4 may take up another inclination in relation to the rotor, shaft 8.

This difference in inclination may originate in any internal or external force or disturbance whatsoever.

In a situation whereby the helicopter 1 is hovering stable, on a spot in the air without any disturbing internal or external forces, the auxiliary rotor 5 keeps turning in a plane which is essentially perpendicular to the rotor shaft 8.

If, however, the body 2 is pushed out of balance due to any disturbance whatsoever, and the rotor shaft 8 turns away from its position of equilibrium, the auxiliary rotor 5 does not immediately follow this movement, since the auxiliary rotor 5 can freely move round the oscillatory shaft 30.

The main rotor 4 and the auxiliary rotor 5 are placed in relation to each other in such a manner that a swinging motion of the auxiliary rotor 5 is translated almost immediately in the pitch or angle of incidence A of the propeller blades 12 being adjusted.

For a two-bladed main rotor 4, this means that the propeller blades 12 and the vanes 28 of both rotors 4 and 5 must be essentially parallel or, seen in the sense of rotation R, enclose an acute angle with one another of for example 100 in the case of a large main rotor 4 and a smaller auxiliary rotor 5.

This angle can be calculated or determined by experiment for any helicopter 1 or per type of helicopter.

If the axis of rotation 8 takes up another inclination than the one which corresponds to the above-mentioned position of equilibrium in a situation whereby the helicopter 1 is hovering, the following happens:

A first effect is that the auxiliary rotor 5 will first try to preserve its absolute inclination, as a result of which the relative inclination of the surface of rotation of the auxiliary rotor 5 in relation to the rotor shaft 8 changes.

As a result, the rod 31 will adjust the angle of incidence A of the propeller blades 12, so that the upward force of the propeller blades 12 will increase on one side of the main rotor 4 and will decrease on the diametrically opposed side of this main rotor.

Since the relative position of the main rotor 4 and the auxiliary rotor 5 are selected such that a relatively immediate effect is obtained. This change in the upward force makes sure that the rotor shaft 8 and the body 21 are forced back into their original position of equilibrium.

A second effect is that, since the distance between the far ends of the vanes 28 and the plane of rotation 14 of the main rotor 4 is no longer equal and since also the vanes 28 cause an upward force, a larger pressure is created between the main rotor 4 and the auxiliary rotor 5 on one side of the main rotor 4 than on the diametrically opposed side.

A third effect plays a role when the helicopter begins to tilt over to the front, to the back or laterally due to a disturbance. Just as in the case of a pendulum, the helicopter will be inclined to go back to its original situation. This pendulum effect does not generate any destabilizing gyroscopic forces as with the known helicopters that are equipped with a stabilizer bar directed transversally to the propeller blades of the main rotor. It acts to reinforce the first and the second effect.

The effects have different origins but have analogous natures. They reinforce each other so as to automatically correct the position of equilibrium of the helicopter 1 without any intervention of a pilot.

The tail rotor 6 is located in a swinging manner and provides for an additional stabilization and makes it possible for the tail rotor 6 to assume the function of the gyroscope which is often used in existing helicopters, such as model helicopters.

In case of a disturbance, the body 2 may start to turn round the rotor shaft 8. As a result, the tail rotor 6 turns at an angle in one or other sense round the swinging shaft 21. This is due to the gyroscopic precession which acts on the rotating tail rotor 6 as a result of the rotation of the tail rotor 6 round the rotor shaft 8. The angular displacement is a function of the amplitude of the disturbance and thus of the rotation of the body 2 round the rotor shaft 8. This is measured by the sensor 27.

The signal of the sensor 27 is used by a control box of a computer to counteract the failure and to adjust the thrust of the tail rotor 6 so as to annul the angular displacement of the tail rotor 6 which is due to the disturbance.

This can be done by adjusting the speed of the tail rotor 6 and/or by adjusting the angles of incidence of the propeller blades of the tail rotor 6, depending on the type of helicopter 1.

Figure 7:
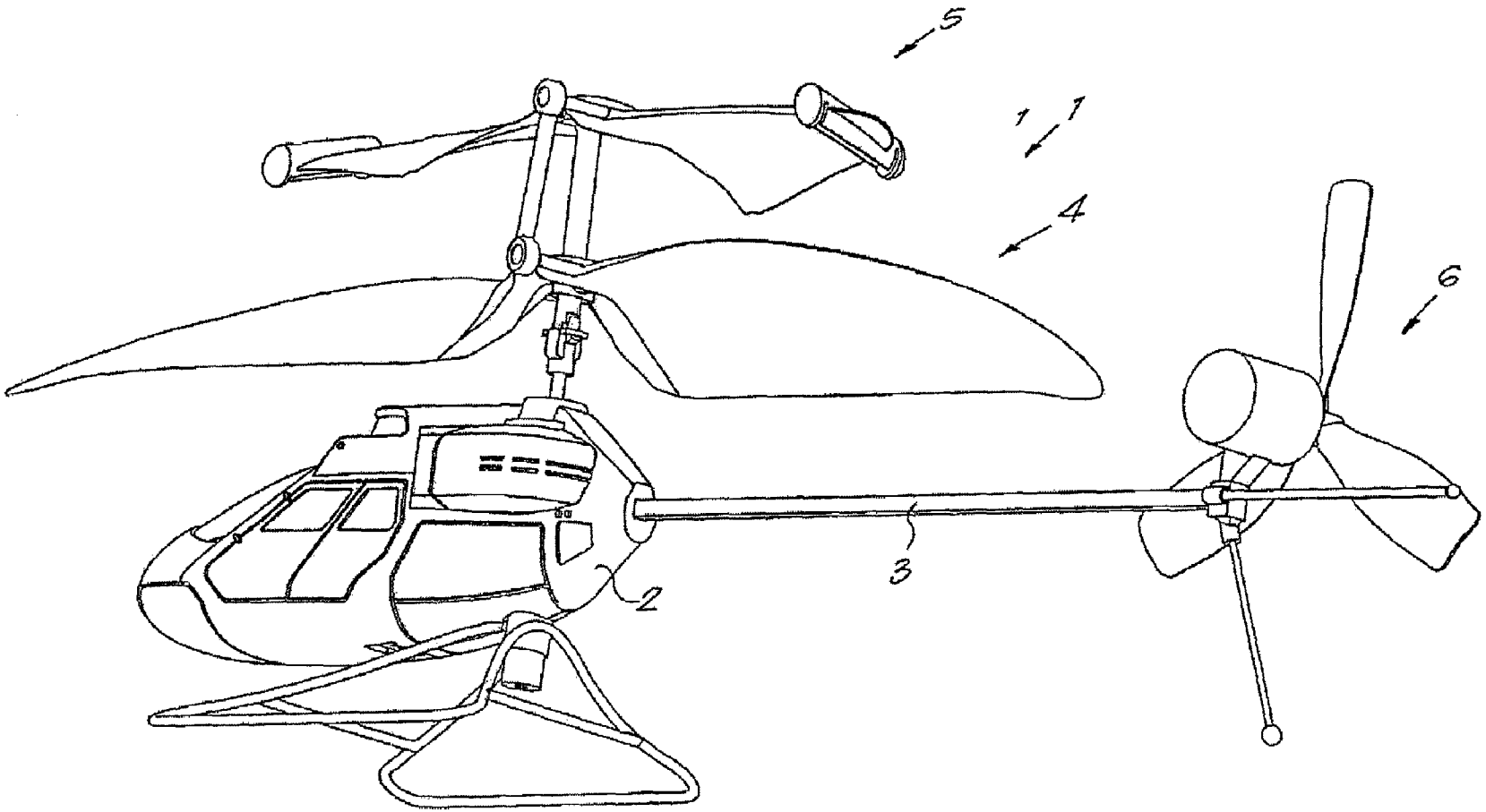
FIG. 7 represents a variant of FIG. 1.
Figure 8:
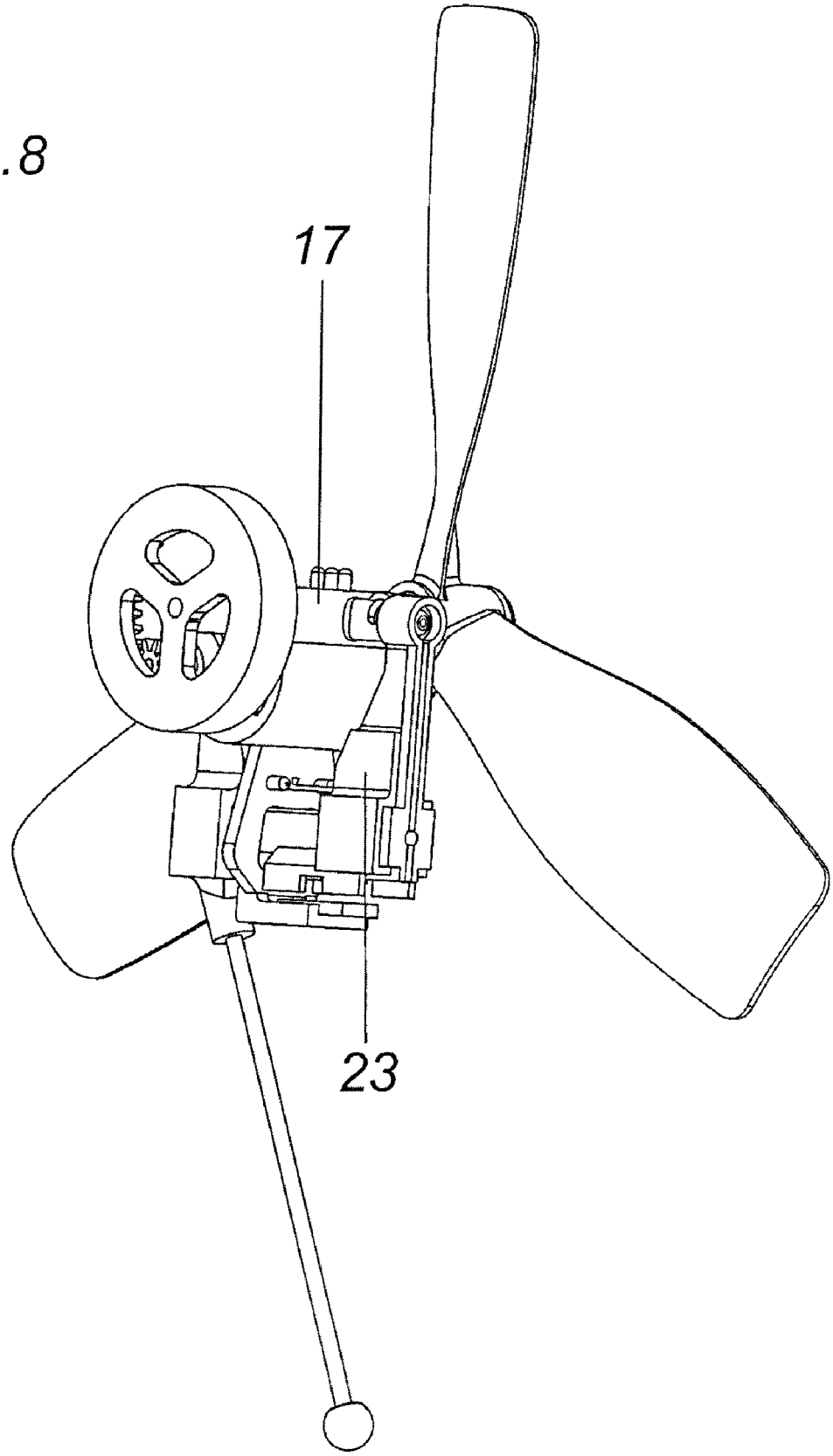
FIG. 8 represents a variant of FIG. 5.
Figure 9:
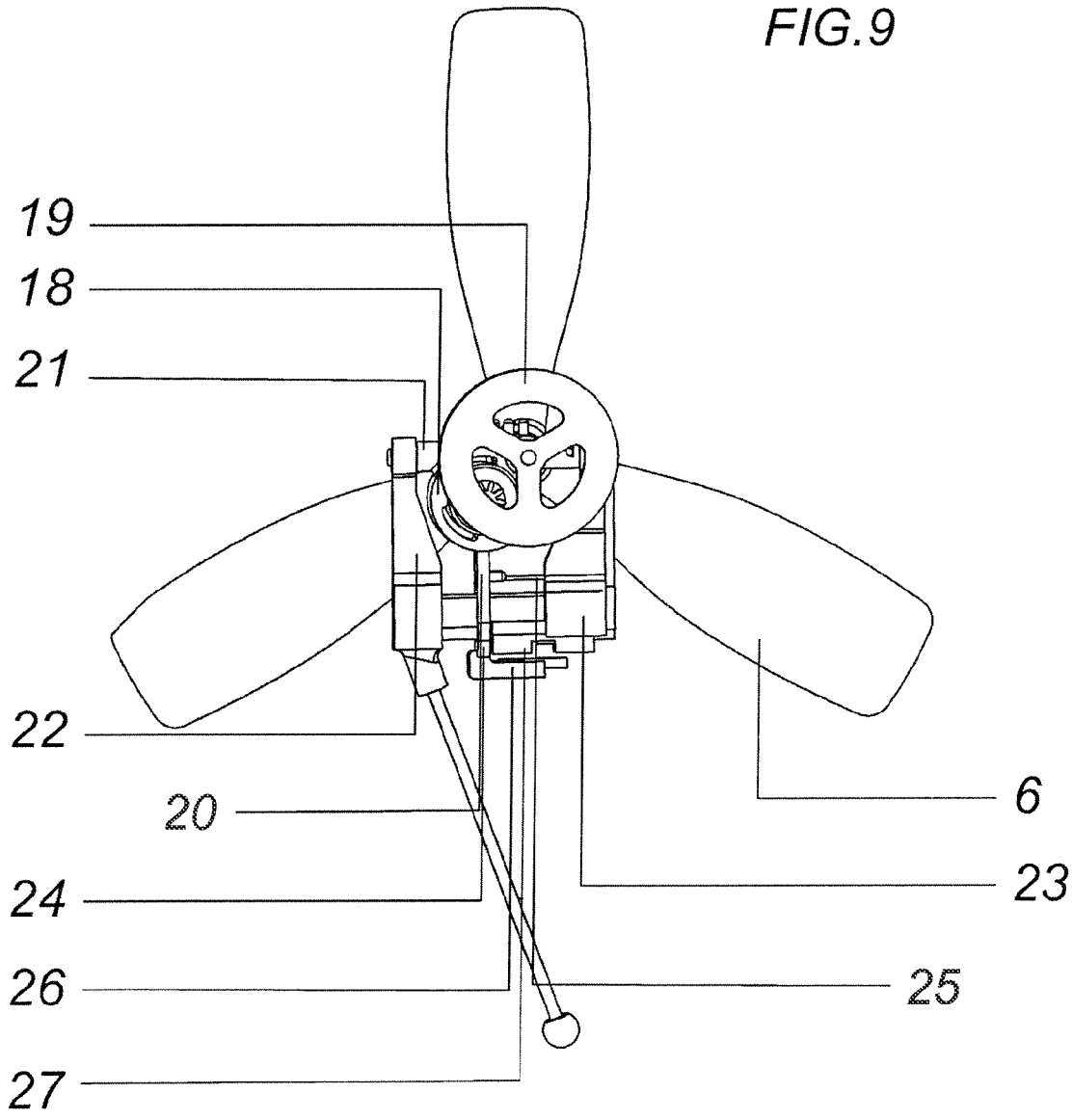
FIG. 9 represents a different view of the tail rotor of FIG. 8.
Figure 10:
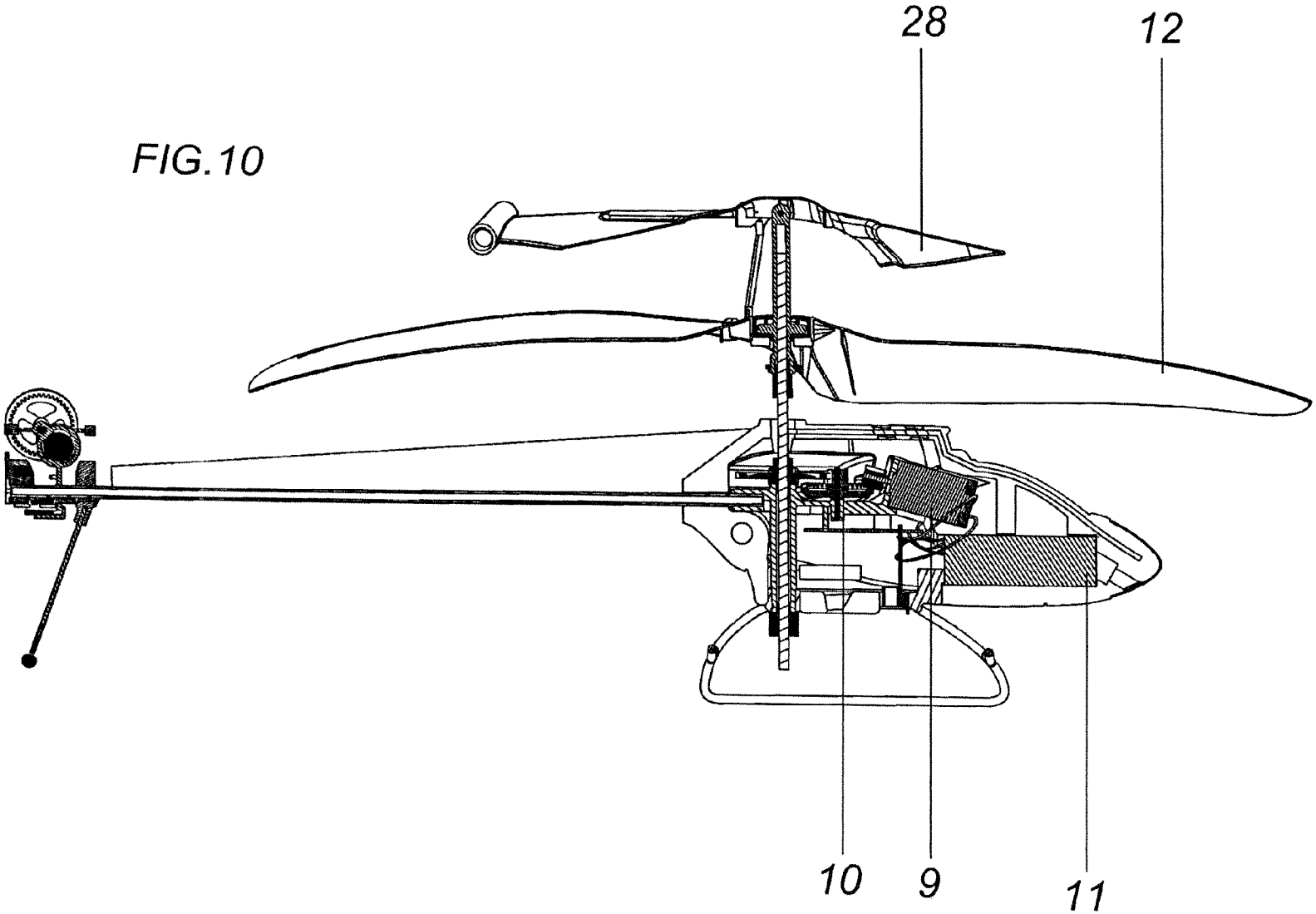
FIG. 10 represents a section of the helicopter.

If necessary, this aspect of the disclosure may be applied separately, just as the aspect of the auxiliary rotor 5 can be applied separately, as is illustrated for example by means of FIG. 7, which represents a helicopter 1 according to the disclosure having a main rotor 4 combined with an auxiliary rotor 5, but whose tail rotor 6 is of the conventional type, i.e. whose shaft cannot turn in a swing but is bearing-mounted in relation to the tail 3.

In practice, the combination of both aspects makes it possible to produce a helicopter which is very stable in any direction and any flight situation and which is easy to control, even by persons having little or no experience.

It is clear that the main rotor 4 and the auxiliary rotor 5 must not necessarily be made as a rigid whole. The propeller blades 12 and the vanes 28 can also be provided on the rotor head 7 such that they are mounted and can rotate relatively separately. In that case, for example, two rods 31 may be applied to connect each time one propeller blade 12 to one vane 28.

It is also clear that, if necessary, the joints and hinge joints may also be realized in other ways than the ones represented, for example by means of torsion-flexible elements.

In the case of a main rotor 4 having more than two propeller blades 12, one should preferably be sure that at least one propeller blade 12 is essentially parallel to one of the vanes 28 of the auxiliary rotor. The joint of the main rotor 4 is preferably made as a ball joint or as a spindle 15 which is directed essentially transversely to the axis of the oscillatory shaft 30 of the auxiliary rotor 5 and which essentially extends in the longitudinal direction of the one propeller blade 12 concerned which is essentially parallel to the vanes 28.

In another format, the helicopter comprises a body with a tail; a main rotor with propeller blades which is driven by a rotor shaft on which the blades are mounted. A tail rotor is driven by a second rotor shaft directed transversally to the rotor shaft of the main rotor. An auxiliary rotor is driven by the rotor shaft of the main rotor and is provided with vanes from the rotor shaft in the sense of rotation of the main rotor.

The auxiliary rotor is mounted in a swinging relationship on an oscillatory shaft and the swinging motion being relatively upwardly and downwardly about the auxiliary shaft. The auxiliary shaft is provided essentially transverse to the rotor shaft of the main rotor. The main rotor and the auxiliary rotor are connected to each other by a mechanical link, such that the swinging motion of the auxiliary rotor controls the angle of incidence of at least one of the propeller blades of the main rotor.

The angle of incidence of the rotor in the plane of rotation of the rotor and the rotor shaft may vary. An auxiliary rotor rotatable with the rotor shaft is for relative oscillating movement about the rotor shaft. Different relative positions are such that the auxiliary rotor causes the angle of incidence the main rotor to be different. A linkage between the main and auxiliary rotor causes changes in the position of the auxiliary rotor to translate to changes in the angle of incidence.

The propeller blades of the main rotor and the vanes of the auxiliary rotor respectively are connected to each other with a mechanical linkage that permits the relative movement between the blades of the propeller and the vanes of the auxiliary rotor. A joint of the main rotor to the propeller blades is formed of a spindle which is fixed to the rotor shaft of the main rotor.

The mechanical link includes a rod hinge mounted to a vane of the auxiliary rotor with one fastening point and is hinge-mounted with another fastening point to the propeller blade of the main rotor.

The body includes wings directed transversely of a longitudinal axis of the helicopter body. The wings are 100 and 102 directed transversely and downwardly whereby the tips 104 and 106 of the wings permit for stabilizing the helicopter body when on the ground.

There is a downwardly directed stabilizer 108 at the tail of the helicopter. FIG. 15 also shows a radio control unit for operation with the helicopter. This unit can have appropriate computerized controls for signaling the operation of the motors operating the rotors and their relative positions.

The present disclosure is not limited to the embodiments described as an example and represented in the accompanying figures. Many different variations in size and scope and features are possible. For instance, instead of electrical motors being provided, other forms of motorized power are possible. A different number of blades may be provided to the rotors.

A helicopter according to the disclosure can be made in all sorts of shapes and dimensions while still remaining within the scope of the disclosure. In this sense although the helicopter in some senses has been described as toy or model helicopter, the features described and illustrated can have use in part or whole in a full-scale helicopter.

What is claimed is:

1. A remote control toy helicopter comprising a body with a tail; a motor and a battery for the motor, the motor being controllable by a controller remote from the helicopter body; a main rotor with propeller blades which is driven by a rotor shaft on which the blades are mounted; a tail rotor which is driven by a second rotor shaft directed transversally to the rotor shaft of the main rotor, an auxiliary rotor driven by the rotor shaft of the main rotor for rotation in the sense of rotation of the main rotor, the auxiliary rotor being mounted such that the generally longitudinal axis of the auxiliary rotor in the sense of rotation, is located at an angle relative to a generally longitudinal axis of one of the propeller blades of the main rotor, and wherein the generally longitudinal axis of the auxiliary rotor is along a center line of the auxiliary rotor passing to the rotor shaft, and the generally longitudinal axis of one of the propeller blades of the main rotor is determined from an end area of the blade to the rotor shaft, and the angle is less than about 25 degrees, and preferably about 10 degrees, and wherein the auxiliary rotor is mounted in a swinging relationship on an oscillatory shaft and the swinging motion being relatively upwardly and downwardly about the oscillatory shaft, and which oscillatory shaft is provided essentially transverse to the rotor shaft of the main rotor, such that the swinging motion of the auxiliary rotor controls the angle of incidence of at least one of the propeller blades of the main rotor, and a joint of the main rotor to the propeller blade formed of a spindle which is fixed to the rotor shaft of the main rotor, the spindle being directed substantially parallel to the generally longitudinal axis of at least one of the propeller blades of the main rotor, the blades being a relatively rigid structure essentially from the end area of one blade through an area adjacent to the rotor shaft to the end area of an opposite blade.

2. A remote control toy helicopter comprising a body with a tail; a motor and a battery for the motor, the motor being controllable by a controller remote from the helicopter body; a main rotor with propeller blades which is driven by a rotor shaft on which the blades are mounted; a tail rotor which is driven by a second rotor shaft directed transversally to the rotor shaft of the main rotor, an auxiliary rotor driven by the rotor shaft of the main rotor for rotation in the sense of rotation of the main rotor, the auxiliary rotor being mounted such that the generally longitudinal axis of the auxiliary rotor is located relative to a generally longitudinal axis of one of the propeller blades of the main rotor, and wherein the auxiliary rotor includes elongated members, the elongated members being directed in the plane defined by the rotation of the auxiliary rotor, and wherein each propeller blade has a profile wherein along the direction of its generally longitudinal axis of each blade includes a first longitudinal convex curve from a position towards the rotor shaft to a position towards an end area of the blade, and wherein the auxiliary rotor is mounted in a swinging relationship on an oscillatory shaft and the swinging motion being relatively upwardly and downwardly about the oscillatory shaft, and which oscillatory shaft is provided essentially transverse to the rotor shaft of the main rotor, such that the swinging motion of the auxiliary rotor controls the angle of incidence of at least one of the propeller blades of the main rotor, and a joint of the main rotor to the propeller blade formed of a spindle which is fixed to the rotor shaft of the main rotor, the spindle being directed substantially parallel to the generally longitudinal axis of at least one of the propeller blades of the main rotor, the blades being a relatively rigid structure essentially from the end area of one blade through an area adjacent to the rotor shaft to the end area of an opposite blade, and wherein each blade includes a second transverse convex curve in a profile on its top face from a position towards a leading edge towards a position towards a trailing edge, the second transverse convex curve preferably being present over a substantial portion of the generally longitudinal length of the blade.

3. A helicopter according to claim 1 wherein the main rotor includes two propeller blades situated essentially in line with each other, and the auxiliary rotor includes two elongated members, selectively vanes, situated essentially in line with each other, preferably there being only the two blades and only the two elongated members, selectively vanes, respectively, and the center line is selectively a line from a radial end area of the auxiliary rotor passing to the rotor shaft.

4. A helicopter according to claim 2 wherein the main rotor includes two propeller blades situated essentially in line with each other, and the auxiliary rotor includes two elongated members, selectively vanes, situated essentially in line with each other, preferably there being only the two blades and only the two elongated members, selectively vanes, respectively, and the center line is selectively a line from a radial end area of the auxiliary rotor passing to the rotor shaft.

5. A helicopter according to claim 2 wherein the main rotor includes two propeller blades situated essentially in line with each other, and the elongated members are respectively two vanes situated essentially in line with each other, preferably there being only the two blades and only the two vanes respectively, and wherein each rotor blade includes a second transverse convex curve in a profile on its top face from a position towards a leading edge towards a position towards a trailing edge, the second transverse convex curve preferably being present over a substantial generally longitudinal length of the blade.

6. A helicopter according to claim 4 wherein the main rotor includes two propeller blades situated essentially in line with each other, and the elongated members are respectively two vanes situated essentially in line with each other, preferably there being only the two blades and only the two vanes respectively, and wherein each rotor blade includes a second transverse convex curve in a profile on its top face from a position towards a leading edge towards a position towards a trailing edge, the second transverse convex curve preferably being present over a substantial generally longitudinal length of the blade.

7. A helicopter according to claim 1 wherein the generally longitudinal axis of the auxiliary rotor is determined along a center line of the auxiliary rotor passing through the rotor shaft, and the generally longitudinal axis of one of the propeller blades of the main rotor is from an end area of the blade to the rotor shaft, and the angle is less than about 25 degrees, and preferably about 10 degrees, and wherein the main rotor includes two propeller blades situated essentially in line with each other, and the auxiliary rotor includes two elongated members, selectively vanes, situated essentially in line with each other, preferably there being only the two blades and only the two elongated members, selectively vanes, respectively, and the center line is selectively a line from a radial end area of the auxiliary rotor to the rotor shaft.

8. A helicopter according to claim 2 wherein the generally longitudinal axis of the auxiliary rotor is determined along a center line of the auxiliary rotor passing through the rotor shaft, and the generally longitudinal axis of one of the propeller blades of the main rotor is from an end area of the blade to the rotor shaft, and an angle between the generally longitudinal axis of the auxiliary rotor and the generally longitudinal axis of one of the propeller blades of the main rotor, in the sense of rotation, is less than about 25 degrees, and preferably about 10 degrees, and wherein the main rotor includes two propeller blades situated essentially in line with each other, and the auxiliary rotor includes two elongated members, selectively vanes, situated essentially in line with each other, preferably there being only the two blades and only the two elongated members, selectively vanes, respectively, and the center line is selectively a line from a radial end area of the auxiliary rotor to the rotor shaft.

9. A helicopter according to claim 1 wherein the propeller blades of the main rotor, and the auxiliary rotor respectively are connected to each other with a mechanical linkage that permits the relative movement between the blades of the propeller and the auxiliary rotor.

10. A helicopter according to claim 2 wherein the propeller blades of the main rotor, and the auxiliary rotor respectively are connected to each other with a mechanical linkage that permits the relative movement between the blades of the propeller and the auxiliary rotor.

11. A helicopter according to claim 1 wherein a fastening point of a rod situated on the main rotor is at a distance from the axis of the spindle of the propeller blades of the main rotor, and another fastening point of the rod is situated on the auxiliary rotor at a distance from the axis of an oscillatory shaft of the auxiliary rotor.

12. A helicopter according to claim 2 wherein a fastening point of a rod situated on the main rotor is at a distance from the axis of the spindle of the propeller blades of the main rotor, and another fastening point of the rod is situated on the auxiliary rotor at a distance from the axis of an oscillatory shaft of the auxiliary rotor.

13. A helicopter according to claim 1 wherein the auxiliary rotor is provided with stabilizing weights which are fixed respectively to elongated members of the auxiliary rotor, the elongated members being directed in the plane of rotation of the auxiliary rotor.

14. A helicopter according to claim 1 wherein the auxiliary rotor is mounted for relative oscillating movement about the rotor shaft so that when one elongated member of the rotor moves relatively upwardly the other elongated arm moves relatively downwardly and being such that for different relative positions, the auxiliary rotor causes the angle of incidence of the main rotor to be different.

15. A helicopter according to claim 2 wherein the auxiliary rotor is mounted for relative oscillating movement about the rotor shaft so that when one elongated member of the rotor moves relatively upwardly the other elongated arm moves relatively downwardly and being such that for different relative positions, the auxiliary rotor causes the angle of incidence of the main rotor to be different.

16. A helicopter according to claim 4 wherein the auxiliary rotor is mounted for relative oscillating movement about the rotor shaft so that when one elongated member of the rotor moves relatively upwardly the other elongated arm moves relatively downwardly and being such that for different relative positions, the auxiliary rotor causes the angle of incidence of the main rotor to be different.

17. A rotor assembly for a remote control toy helicopter, comprising a motor and a battery for the motor, the motor being controllable by a controller remote from the helicopter body; a main rotor having two propeller blades mounted on a rotor shaft for rotation with the rotor shaft, an auxiliary rotor mounted on the rotor shaft for rotation in the sense of rotation of the main rotor, the auxiliary rotor being mounted in a swinging relationship on an oscillatory shaft provided essentially transverse to the rotor shaft of the main rotor and the swinging motion being relatively upwardly and downwardly about the oscillatory shaft, the main rotor and the auxiliary rotor having planes of rotation spaced from each other and being linked with each other by a mechanical linkage, such that the swinging motion of the auxiliary rotor controls an angle of incidence of the propeller blades of the main rotor, and wherein at least one propeller blade of the main rotor is for pivotably mounting on a spindle which is fixed on the rotor shaft, a longitudinal axis of the main rotor being from an end of one blade towards the rotor shaft, and wherein each propeller blade has a profile wherein along the direction of it generally longitudinal axis of each blade includes a first longitudinal convex curve from a position towards the rotor shaft to a position towards an end area of the blade, the convex curve extending over a portion of the length of the blade, and wherein each blade includes a second transverse convex curve in a profile on its top face from a position towards a leading edge towards a position towards a trailing edge, the second transverse convex curve preferably being present over a substantial portion of the generally longitudinal length of the blade.

18. A rotor assembly according to claim 17, wherein the upper surface of each propeller blade is convex along a significant portion of an axis of the blade, and the lower surface is concave along the same portion of the axis of the blade, the upper and lower surfaces being parallel along the axis, wherein the axis passes through the center of rotation of the blade and to the tips of the blades.

19. A rotor assembly according to claim 17, wherein the top surface of each propeller blade along the leading edge of each blade is a convex curve along a significant portion of its length, oriented with the peak uppermost, in a plane perpendicular to the plane of rotation of each blade.

20. A rotor assembly according to claim 17, wherein the bottom surface of each propeller blade along the leading edge of each blade is a concave curve along a significant portion of its length, oriented with the peak uppermost, in a plane perpendicular to the plane of rotation of each blade.

* * * * *